US007590374B2

(12) United States Patent
Takami

(10) Patent No.: US 7,590,374 B2
(45) Date of Patent: Sep. 15, 2009

(54) CONVEYOR DEVICE AND IMAGE FORMING APPARATUS

(75) Inventor: Nobuo Takami, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/928,777

(22) Filed: Oct. 30, 2007

(65) Prior Publication Data

US 2008/0063435 A1 Mar. 13, 2008

Related U.S. Application Data

(63) Continuation of application No. 11/763,874, filed on Jun. 15, 2007, now Pat. No. 7,426,362, and a continuation of application No. 10/924,873, filed on Aug. 25, 2004, now Pat. No. 7,248,824.

(30) Foreign Application Priority Data

Aug. 25, 2003 (JP) ..... 2003-300342

(51) Int. Cl.
*G03G 15/08* (2006.01)

(52) U.S. Cl. ..... 399/258; 399/262

(58) Field of Classification Search ..... 399/258, 399/260, 119, 120, 110, 262; 222/DIG. 1
See application file for complete search history.

(56) References Cited

U.S. PATENT DOCUMENTS 5,384,628 A 1/1995 Takami et al. ..... 399/255
6,009,293 A 12/1999 Takami ..... 399/227
6,285,099 B1 9/2001 Takami ..... 310/51
6,321,056 B1 11/2001 Takami ..... 399/274
6,442,364 B2 8/2002 Kai et al. ..... 399/277
6,498,917 B2 12/2002 Takami ..... 399/227
6,505,022 B2 1/2003 Kosuge et al. ..... 399/159

(Continued)

FOREIGN PATENT DOCUMENTS

EP 1 229 402 A2 8/2002

(Continued)

OTHER PUBLICATIONS

U.S. Appl. No. 10/829,227, filed Apr. 22, 2004, Muramatsu, et al.

(Continued)

*Primary Examiner*—Sophia S Chen
(74) *Attorney, Agent, or Firm*—Oblon, Spivak, McClelland, Maier & Neustadt, P.C.

(57) ABSTRACT

A toner-conveying device includes a movable plate. The movable plate is movable between a holding position such as to couple a cap of a toner container to a nozzle when the toner container is supported by a container holder, and a retreating position such as not to hinder loading and unloading of the toner container in the container holder. The movable plate is placed in the holding position by a cam when the nozzle is coupled to the cap, and is released and moved to the retreating position while the toner container is being loaded or unloaded. In this structure, the cap can be properly positioned in the conveyor device while ensuring the rigidity of a bag of the container within a practically preferable range, without reducing the convenience for the operator.

29 Claims, 13 Drawing Sheets

U.S. PATENT DOCUMENTS

| | | | | |
|---|---|---|---|---|
| 6,665,508 | B2 * | 12/2003 | Sudo et al. | 399/258 |
| 6,728,504 | B2 | 4/2004 | Ariizumi et al. | 399/267 |
| 6,782,234 | B2 | 8/2004 | Takami | 399/359 |
| 6,871,034 | B2 | 3/2005 | Muramatsu et al. | |
| 6,882,817 | B2 | 4/2005 | Kita | |
| 7,085,522 | B2 | 8/2006 | Muramatsu et al. | |
| 7,133,629 | B2 | 11/2006 | Kita | 399/258 |
| 2002/0114646 | A1 | 8/2002 | Sudo et al. | 399/258 |
| 2003/0012586 | A1 | 1/2003 | Iwata et al. | 399/258 |
| 2003/0081969 | A1 | 5/2003 | Muramatsu et al. | 399/258 |
| 2004/0037591 | A1 | 2/2004 | Schlageter et al. | 399/258 |
| 2004/0131392 | A1 * | 7/2004 | Matsumoto et al. | 399/262 |
| 2005/0226655 | A1 | 10/2005 | Katsuyama et al. | 399/258 |
| 2005/0281592 | A1 | 12/2005 | Muramatsu et al. | |
| 2006/0002743 | A1 | 1/2006 | Katsuyama et al. | |
| 2007/0077098 | A1 | 4/2007 | Katsuyama et al. | |
| 2007/0092303 | A1 | 4/2007 | Katsuyama et al. | |
| 2007/0122204 | A1 | 5/2007 | Kita | |

FOREIGN PATENT DOCUMENTS

| | | |
|---|---|---|
| JP | S60-59579 | 4/1985 |
| JP | 2003-202745 | 7/2003 |

OTHER PUBLICATIONS

U.S. Appl. No. 11/980,412, filed Oct. 31, 2007, Katsuyama, et al.

* cited by examiner

CONVEYOR DEVICE AND IMAGE FORMING APPARATUS

CROSS-REFERENCE TO RELATED APPLICATIONS

The present continuation application claims the benefit of priority under 35 U.S.C. §120 to application Ser. No. 11/763,874, filed on Jun. 15, 2007, now U.S. Pat. No. 7,426,362 and application Ser. No. 10/924,873, filed Aug. 25, 2004, now U.S. Pat. No. 7,248,824, and under 35 U.S.C. §119 from Japanese Patent Application No. 2003-300342, filed Aug. 25, 2003, the entire contents of each are incorporated herein by reference.

BACKGROUND OF THE INVENTION

1. Field of the Invention

The present invention relates to a conveyor device for conveying, for example, powder, liquid, or gas stored in a flexible container to other devices, and to an image forming apparatus that uses the conveyor device as a toner-conveying device.

2. Description of the Related Art

This type of conveyor device is used in various technical fields. For example, conveyor devices disclosed in Japanese Unexamined Patent Application Publication Nos. 2001-194907, 2001-324863, and 2002-72649 are used in the field of an image forming apparatus. These conveyor devices are used as toner-conveying devices that supply toner from a toner container to a developing device. The toner container mounted in the toner-conveying devices is made of a bag-shaped flexible material, and can be contracted and reduced in volume by a suction force of a suction pump. The shape and size of a hard toner container, such as a cartridge or a bottle, does not change with use. In contrast, the volume of the toner container disclosed in the above publications decreases with use. Therefore, this toner container is easier for the user to handle after use than the hard bottle container. Moreover, it is possible to reduce the cost of transporting the toner container from the user to a manufacturer in order to replace the used toner container by a new one for reclaiming.

In such a flexible toner container, a cap made of, for example, plastic is generally mounted at an opening provided in a flexible bag. In order to supply toner to the developing device, the toner container is loaded in the toner-conveying device, and the cap of the toner container is then engaged with a nozzle (conveying-path forming member) of the toner-conveying device. The interior of the toner container thereby communicates with the conveying path in the toner-conveying device. Toner stored in the toner container is conveyed to the developing device through the conveying path by a suction force of the suction pump.

When the flexible toner container is loaded in the toner-conveying device, the cap must be properly placed in a predetermined position (setting position) in the toner-conveying device so as to be coupled to the nozzle in a normal manner. However, the cap frequently collides with or is pushed by other things during distribution and handling before loading. Since the bag of the toner container is flexible, the posture of the cap is interfered with by such a collision or push.

FIG. 13 is a side view showing an example of a toner container in which a cap is in an incorrect posture. A bag of the toner container has folds on its side faces (front and rear sides of the plane of the figure) so as to take a predetermined shape after volume reduction. However, folds are not provided on front and rear faces (left and right sides of the plane of the figure) of the bag. For this reason, the front and rear faces of the bag have a flexural rigidity lower than that of the side faces. Therefore, the cap tends to tilt toward the front or rear face of the bag and interferes with its posture, as shown in FIG. 13. In particular, since a portion of the bag near the cap is tapered so that inner toner easily concentrates at the cap during a toner supply operation, the posture of the cap is prone to be interfered with.

When the toner container having the cap in an incorrect posture is loaded in the toner-conveying device, the cap is not placed in a predetermined position inside the toner-conveying device. Therefore, the nozzle of the toner-conveying device is not properly coupled to the cap, and a normal toner supply operation cannot be performed. Although the operator can correct the posture of the cap before loading, this is troublesome for the operator, and convenience for the operator is substantially reduced.

Even when the cap is in a correct posture before loading, if the cap collides with something while the toner container is being loaded in the toner-conveying device, the posture of the cap is easily interfered with because the bag of the toner container is flexible. Therefore, the operator also must take care so that the posture of the cap will not be interfered with during loading of the toner container, and this reduces convenience.

While the operator generally loads the toner container while holding the bag, it is difficult for the operator to correct the posture of the cap by handling the held portion. Since the bag is flexible, a force applied to the held portion by the operator is not easily transmitted to the cap, and it is difficult for the operator holding the bag to control the position and posture of the cap.

In order to properly place the cap in a predetermined position without reducing the convenience for the operator, two methods for preventing interference with the posture of the cap can be adopted.

More specifically, a first method is to increase the thickness of the bag for higher rigidity. In this method, however, since a sheet material that forms the bag is thick, heat is not easily transmitted to the inner side of the sheet material during a seam-welding process for welding a seam of the sheet. For this reason, welding failure may occur, or the strength may decrease. In order to prevent welding failure or a decrease in strength, time taken for the seam-welding process must be increased, and the manufacturing cost of the bag increases. When the posture of the cap is interfered with by an external force for some reason, creases are made and clearly remain after the posture is corrected. Consequently, the bag does not take a desired shape after volume reduction, but deforms into an undesirable shape along the creases.

A second method is to reduce the rigidity of the bag so that the posture of the cap is easily corrected. In this method, however, the thickness of the sheet material of the bag is reduced, and a portion of the bag near the cap is first crushed at the early stage of the volume reduction process. When the portion is crushed, discharging of toner from the toner container is hindered, the amount of toner to be discharged varies, and much toner remains in the toner container. Furthermore, since the operator generally holds the bag, as described, when the bag is too soft, ease of handling and convenience are reduced.

From the above viewpoints, there is a practically desirable range of rigidity of the bag in the toner container, and it is difficult to overcome the above problems in the range by preventing the posture of the cap from being interfered with.

The above problems occur not only to the mechanism for supplying toner from the toner container to the developing device, but also to a mechanism for conveying a material stored in a container made of a flexible material to other devices.

SUMMARY OF THE INVENTION

In view of the above-described background, an object of the present invention is to provide a conveyor device in which the rigidity of a bag of a container is within a practically preferable range, and a cap of the container can be placed in the right position without reducing convenience for the operator, and to provide an image forming apparatus including the conveyor device.

In order to achieve the above object, according to an aspect, the present invention provides a conveyor device including a container support for supporting a detachable container in which a substance stored in a flexible bag is discharged through a cap provided at an opening of the bag while an external pressure is applied to the bag or the inner pressure of the bag is reduced in order to deform the bag and to reduce the volume of the bag; a conveying-path forming member that is to be coupled to the cap of the container supported by the container support and that defines a conveying path in which the substance discharged from the container is conveyed to a destination; a cap holder movable between a holding position such as to movable between a holding position such as to couple the cap of the container to the conveying-path forming member when the container is supported by the container support, and a retreating position such as not to hinder loading and unloading of the container into and from the container support; and a positioning unit for placing the cap holder in the holding position.

Preferably, when the container is supported by the container support, a portion of the bag having a relatively low flexural rigidity near the cap faces in a direction that substantially coincides with a moving direction of the cap holder.

Preferably, the conveying-path forming member is inserted in the cap substantially in a moving direction of the cap holder to form the conveying path.

Preferably, the conveyor device further includes a conveying-path-forming-member driving mechanism that moves the conveying-path forming member between a coupled position and an uncoupled position. The conveying-path forming member is coupled to the cap of the container supported by the container support at the coupled position, and does not hinder loading and unloading of the container into and from the container support at the uncoupled position. The cap holder is placed in the holding position by the positioning unit in response to a motion of the conveying-path-forming-member driving mechanism for moving the conveying-path forming member from the uncoupled position to the coupled position, and the positioning of the cap holder by the positioning unit is released in response to a motion of the conveying-path-forming-member driving mechanism for moving the conveying-path forming member from the coupled position to the uncoupled position.

Preferably, the conveyor device further includes a container-support driving mechanism that moves the container support between a loading position at which the container is loaded into or unloaded from the container support and a stored position at which the container supported by the container support is stored in the conveyor device. The conveying-path-forming-member driving mechanism moves the conveying-path forming member from the uncoupled position to the coupled position in response to a motion of the container-support driving mechanism for moving the container support from the loading position to the stored position, and moves the conveying-path forming member from the coupled position to the uncoupled position in response to a motion of the container-support driving mechanism for moving the container support from the stored position to the loading position.

Preferably, the movement of the conveying-path forming member from the uncoupled position to the coupled position is completed after the cap holder is placed in the holding position by the positioning unit.

Preferably, the conveyor device further includes a container-support driving mechanism that moves the container support between a loading position at which the container is loaded into or unloaded from the container support and a stored position at which the container supported by the container support is stored in the conveyor device. The cap holder is placed in the holding position by the positioning unit in response to a motion of the container-support driving mechanism for moving the container support from the loading position to the stored position, and the cap holder is released from the positioning unit in response to a motion of the container-support driving mechanism for moving the container support from the stored to the loading position.

Preferably, when the conveying-path forming member is inserted in a through hole of the cap communicating with the opening so as to change places with a shutter mounted in the cap that plugs the through hole, the conveying path communicates with the opening.

Preferably, a direction of insertion of the conveying-path forming member is substantially orthogonal to a loading and unloading direction of the container into and from the container support.

Preferably, the cap holder is released from the positioning unit after the shutter member returns in the through hole so as to change places with the cap.

Preferably, the conveyor device further includes a conveying-path-forming-member driving mechanism that moves the conveying-path forming member between a coupled position and an uncoupled position, the conveying-path forming member being coupled to the cap of the container supported by the container support at the coupled position and not hindering loading and unloading of the container into and from the container support at the uncoupled position; and a cap moving mechanism that moves the cap in a coupling direction in response to a motion of the conveying-path-forming-member driving mechanism for moving the conveying-path forming member from the uncoupled position to the coupled position and that moves the cap in a direction opposite to the coupling direction in response to a motion of the conveying-path-forming-member driving mechanism for moving the conveying-path forming member from the coupled position to the uncoupled position.

Preferably, the conveying-path-forming-member driving mechanism is a link mechanism.

According to another aspect, the present invention provides a conveyor device including a container support for supporting a detachable container in which a substance stored in a flexible bag is discharged through a cap provided at an opening of the bag while an external pressure is applied to the bag or the inner pressure of the bag is reduced in order to deform the bag and to reduce the volume of the bag; a conveying-path forming member that is to be coupled to the cap of the container supported by the container support and that defines a conveying path in which the substance discharged from the container is conveyed to a destination; a conveying-path-forming-member driving mechanism that moves the conveying-path forming member between a coupled position and an uncoupled position, the conveying-path forming member being coupled to the cap of the container supported by the container support at the coupled position and not hindering loading and unloading of the container into and from the container support at the uncoupled position; and a cap moving mechanism that moves the cap in a coupling direction in response to a motion of the conveying-path-forming-member driving mechanism for moving the conveying-path forming member from the uncoupled position to the coupled position and that moves the cap in a direction opposite to the coupling direction in response to a motion of the conveying-path-forming-member driving mechanism for moving the conveying-path forming member from the coupled position to the uncoupled position.

Preferably, the conveyor device conveys toner stored in the container to a developing device provided in an image forming apparatus.

According to a further aspect, the present invention provides an image forming apparatus including a developing device that develops a latent image formed on a latent-image bearing member with toner to form a toner image, and that transfers the toner image onto a recording medium to form an image; a container that stores the toner conveyed to the developing device; and the above conveyor device for conveying the toner from the container to the developing device.

In the conveyor device and the image forming apparatus described above, the cap holder can be placed in the holding position by the positioning unit when the conveying-path forming member is coupled to the cap. Therefore, the cap of the container supported by the container support is held in the right position by the cap holder. Accordingly, the cap and the conveying-path forming member can be properly coupled, and a normal toner supply operation is achieved.

The holding position refers to a proper setting position for the cap, in general, a position at which the cap lies in a correct posture when the container is supported by the container support. Therefore, when the posture of the cap is correct, even when the cap holder is fixedly placed in the holding position, the cap can be held in the proper setting position. However, when the cap holder is thus fixedly positioned, a region in which the cap can lie when the container is supported in the container holder (hereinafter referred to as a "setting region") is limited to a region in which the cap lies in a correct posture. In this case, in a state in which the posture of the cap is interfered with, when the container is supported by the container holder, the cap is obstructed by the cap holder and cannot enter the setting region. As a result, the cap cannot be held in the proper setting position, and a normal toner supply operation cannot be achieved.

Accordingly, in the conveyor device of the present invention, the cap holder is movable to the retreating position such as not to hinder loading and unloading of the container into and from the container support. Therefore, the cap holder can be moved to the retreating position by releasing the positioning by the positioning unit when loading and unloading the container into and from the container holder. In this case, even when the cap of the container is in an incorrect posture, it is not obstructed by the cap holder, and the container can be reliably supported by the container holder. More specifically, when the cap holder moves to the retreating position, the setting region is thereby enlarged, and so-called "play" is produced in the region. Even when the posture of the cap is interfered with, if the interference is within the play, the cap can enter the setting region when the container is supported by the container holder. After the container is thus supported by the container support, the cap holder can be placed in the holding position by the positioning unit, and the cap can be held in a proper setting position. Therefore, even when the cap is in an incorrect posture, the operator can load the container in the container holder without correcting the posture. Moreover, the cap is reliably coupled to the conveying-path forming member, and a normal toner supply operation is achieved.

The container can be loaded and unloaded as long as the cap holder is released from positioning in the holding position. Therefore, the cap holder may be movable between the holding position and the retreating position, or may positively move to the retreating position. In the former case, the cap can push the movable cap holder toward the retreating position when loading and unloading the container. Therefore, the cap is not obstructed by the cap holder.

As described above, the container having the cap in an incorrect posture can be loaded in the conveyor device and the cap can be held at a proper setting position by improving the configuration of the conveyor device. Therefore, the cap can be placed a right setting position in the conveyor device while maintaining the rigidity of the bag of the container within a practically preferable range, without reducing the convenience for the operator.

Further objects, features, and advantages of the present invention will become apparent from the following description of the preferred embodiments with reference to the attached drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
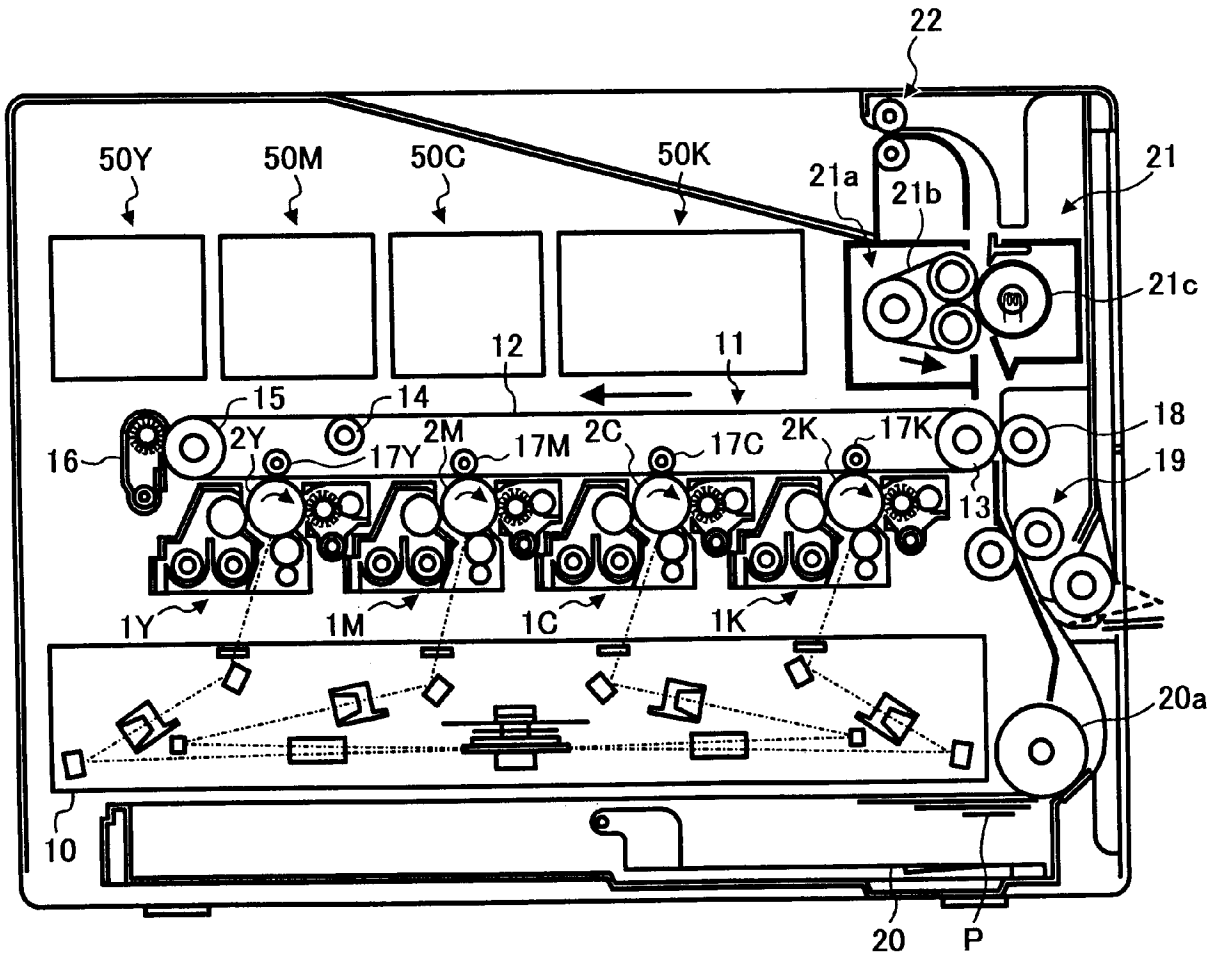
FIG. 1 is a schematic structural view of a printer according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, a tandem color laser printer (hereinafter simply referred to as a "printer") including a plurality of photosensitive members arranged side by side will be described below as an image forming apparatus according to an embodiment of the present invention.

First, the basic configuration of the printer will be described.

FIG. 1 is a schematic structural view of the printer of this embodiment. The printer includes four process units 1Y, 1M, 1C, and 1K for forming images of yellow (Y), magenta (M), cyan (C), and black (K). Letters Y, M, C, and K following reference numerals of the components indicate that the components are provided, respectively, for yellow, magenta, cyan, and black. The printer also includes an optical writing unit 10, an intermediate transfer unit 11, a secondary transfer bias roller 18, a pair of register rollers 19, a sheet cassette 20, and a belt-type fixing unit 21.

The optical writing unit 10 includes a light source, a polygonal mirror, an f-θ lens, and a reflecting mirror, and applies laser light on the surfaces of photosensitive members, which will be described later, according to image information.

Figure 2:
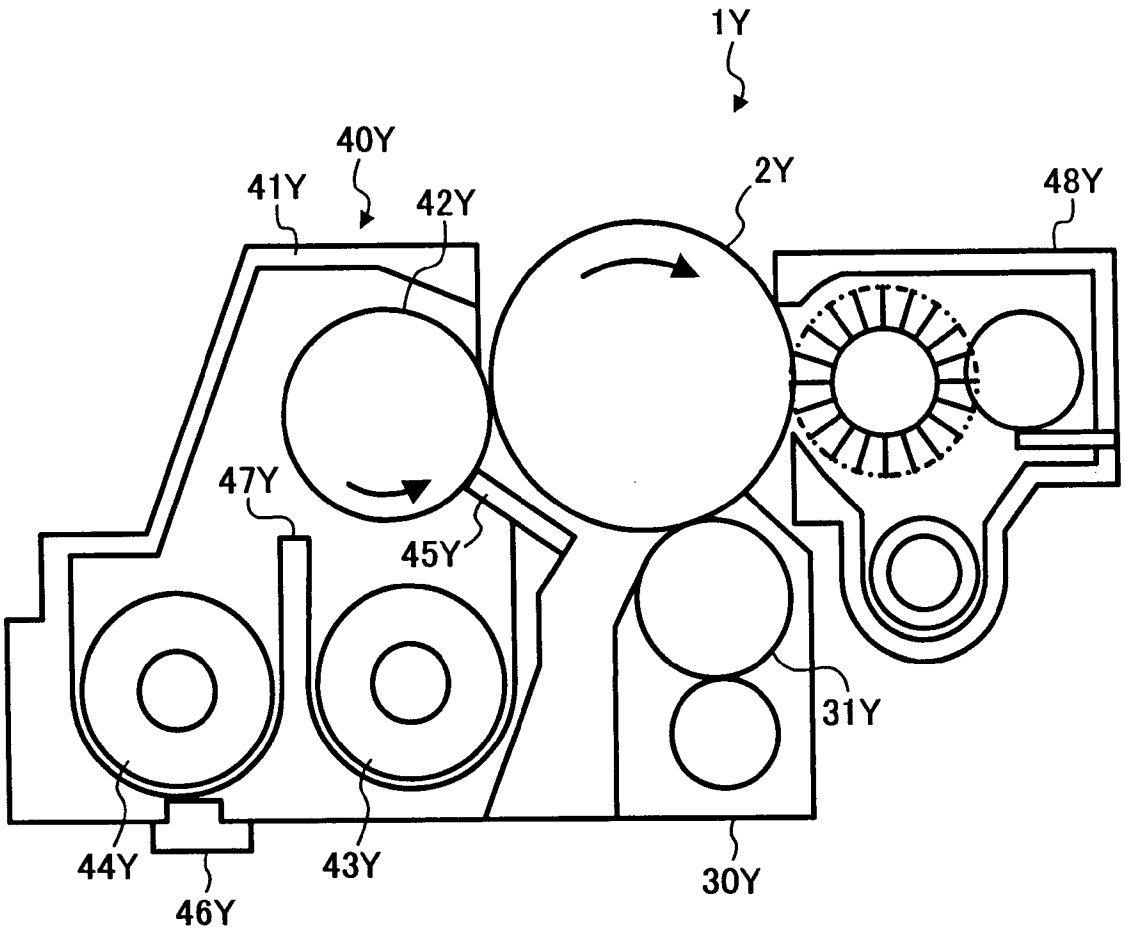
FIG. 2 is an enlarged view schematically showing the configuration of a yellow process unit in the printer.

FIG. 2 is an enlarged view schematically showing the configuration of the yellow process unit 1Y of the above-described process units 1Y, 1M, 1C, and 1K. Since the other process units 1M, 1C, and 1K have the same configuration as that of the yellow process unit 1Y, descriptions thereof are omitted. As shown in FIG. 2, the process unit 1Y includes a photosensitive drum 2Y, a charger 30Y, a developing device 40Y, a drum-cleaning device 48Y, and a discharger (not shown).

The charger 30Y uniformly charges the surface of the photosensitive drum 2Y in the dark by bringing a charging roller 31Y, to which an AC voltage is applied, into sliding contact with the sensitive drum 2Y. The charged surface of the photosensitive drum 2 is scanned with laser light modulated and deflected by the optical writing unit 10, thereby forming an electrostatic latent image thereon. The electrostatic latent image is developed into a yellow toner image by the developing device 40Y.

The developing device 40Y includes a developing roller 42Y with its peripheral surface partly exposed from an opening of a development case 41Y. The developing device 40Y also includes a first conveyor screw 43Y, a second conveyor screw 44Y, a doctor blade 45Y, a toner-concentration sensor (hereinafter referred to as a "T-sensor") 46Y.

The development case 41Y stores a two-component developing agent (not shown) containing magnetic carriers and yellow toner particles to be negatively charged. The two-component developing agent is frictionally charged while being agitated and conveyed by the first conveyor screw 43Y and the second conveyor screw 44Y, and is then placed on the surface of the developing roller 42Y The two-component developing agent is conveyed to a developing region opposing the photosensitive drum 2Y after its layer thickness is regulated by the doctor blade 45Y, and yellow toner particles are adsorbed on an electrostatic latent image formed on the photosensitive drum 2Y to form a yellow toner image. The two-component developing agent from which the yellow toner particles are reduced by development is returned into the development case 41Y with the rotation of the developing roller 42Y.

A partition 47Y is provided between the first conveyor screw 43Y and the second conveyor screw 44Y. The partition 47Y separate the interior of the development case 41Y into a first supply section that includes the developing roller 42Y and the first conveyor screw 43Y, and a second supply section that includes the second conveyor screw 44Y. The first conveyor screw 43Y is rotated by a driving means (not shown) to convey a two-component developing agent in the first conveying section from the front side of the plane of the figure to the back side and to supply the agent to the developing roller 42Y. The two-component developing agent conveyed to the adjacency of an end of the first supply section by the first conveyor screw 43Y enters the second supply section through an opening (not shown) provided in the partition 47Y In the second supply section, the second conveyor screw 44Y is rotated by a driving means (not shown) to convey the two-component developing agent supplied from the first supply section in an direction opposite from the conveying direction of the first conveyor screw 43Y The two-component developing agent is conveyed near an end of the second supply section, and returns into the first supply section through another opening (not shown) provided in the partition 47Y.

The T-sensor 46Y is formed of a magnetic-permeability sensor, and is provided on a bottom wall at almost the center of the second supply section to output a voltage corresponding to the magnetic permeability of the two-component developing agent passing thereon. Since the magnetic permeability of the two-component developing agent has some correlation with the toner concentration, the T-sensor 46Y outputs a voltage corresponding to the yellow toner concentration. The output voltage is sent to a control unit (not shown). The control unit includes a RAM that stores a target output voltage Y-Vtref from the T-sensor 46Y The RAM also stores target output voltages M-Vtref, C-Vtref, and K-Vtref from T-sensors (not shown) mounted in the other developing devices. The value Y-Vtref is used to control the driving a yellow-toner conveying device. More specifically, the control unit supplies yellow toner into the above-described second supply section while controlling the driving of the yellow-toner conveying device so that the output voltage from the T-sensor 46Y becomes close to Y-Vtref. By this supply, the concentration of yellow-toner in the two-component developing agent in the developing device 40Y is maintained within a predetermined range. Similar toner supply control is executed in the developing devices of the other process units.

A yellow toner image formed on the photoconductive drum 2Y is transferred onto an intermediate transfer belt (not shown) which will be described later. After intermediate transfer, the surface of the photosensitive drum 2Y is cleaned of residual toner by the drum-cleaning device 48Y, and is discharged by a discharging lamp. Then, the surface of the photosensitive drum 2Y is uniformly charged by the charger 30Y for the next image-forming operation. This also applies to the other process units.

Referring again to FIG. 1, the intermediate transfer unit 11 includes an intermediate transfer belt 12, a driving roller 13, belt-stretching rollers 14 and 15, a belt cleaner 16, and four intermediate transfer bias rollers 17Y, 17M, 17C, and 17K. The intermediate transfer belt 12 is tightly stretched around the driving roller 13 and the belt-stretching rollers 14 and 15, and is moved counterclockwise in an endless manner by the driving roller 13 that is rotated by a driving system (not shown). An intermediate transfer bias is applied from a power supply (not shown) to the four intermediate transfer bias rollers 17Y, 17M, 17C, and 17K. The intermediate transfer belt 12 is pressed against photosensitive drums 2Y, 2M, 2C, and 2K from the back side to form intermediate transfer nips therebetween. At the intermediate transfer nips, intermediate transfer fields are formed between the photosensitive drums 2Y, 2M, 2C, and 2K and the intermediate transfer bias rollers 17Y, 17M, 17C, and 17K by the influence of the intermediate transfer bias. A yellow toner image formed on the photosensitive drum 2Y is transferred onto the intermediate transfer belt 12 by the intermediate transfer field and a nip pressure. Magenta, cyan, and black toner images formed on the photosensitive drums 2M, 2C, and 2K are sequentially transferred on the yellow toner image, thus forming a superimposed toner image on the intermediate transfer belt 12. The superimposed toner image is secondarily transferred onto a transfer paper sheet P serving as a recording medium at a secondary transfer nip which will be described later. On the other hand, toner remaining on the surface of the intermediate transfer belt 12 passing through the secondary transfer nip is removed by the belt cleaner 16 that is in contact with a portion of the intermediate transfer belt 12 backed by the belt-stretching roller 15.

The sheet cassette 20 is provided below the optical writing unit 10, and accommodates a plurality of stacked transfer paper sheets P. A supply roller 20*a* is in pressed contact with the uppermost transfer paper sheet P. When the supply roller 20*a* rotates at a predetermined timing, the uppermost transfer paper sheet P is supplied to a sheet-feeding path.

The secondary transfer bias roller 18 is in contact with the driving roller 13 of the intermediate transfer unit 11 with the intermediate transfer belt 12 therebetween, thus forming a secondary transfer nip. A secondary transfer bias is applied from a power supply (not shown) to the secondary transfer bias roller 18.

A transfer paper sheet P supplied from the sheet cassette 20 to the sheet-feeding path is nipped between the register rollers 19. On the other hand, a superimposed toner image formed on the intermediate transfer belt 12 enters the secondary transfer nip with the endless motion of the intermediate transfer belt 12. The register rollers 19 deliver the nipped transfer paper sheet P at a timing such that the transfer paper sheet P can be brought into tight contact with the superimposed toner image at the secondary transfer nip. The superimposed toner image is thereby brought into tight contact with the transfer paper sheet P at the secondary transfer nip. The superimposed toner image is secondarily transferred onto the transfer paper sheet P by the secondary transfer bias and the nip pressure, and forms a full-color image in connection with white color of the transfer paper sheet P. The transfer paper sheet P on which the full-color image is thus formed is conveyed to the fixing unit 21.

The fixing unit 21 includes a belt unit 21*b* in which a fixing belt 21*a* tightly stretched by three rollers is moved in an endless manner, and a heating roller 21*c* having a heat source therein. The full-color image is fixed while nipping the transfer paper sheet P between the belt unit 21*b* and the heating roller 21*c*. The transfer paper sheet P passing through the fixing unit 21 is ejected out of the printer through a pair of ejection rollers 22.

In the printer having the above-described configuration, the process units 1Y, 1M, 1C, and 1K, the intermediate transfer unit 11, and so on constitute a visible-image forming means that forms a toner image as a visible image on a transfer paper sheet P as a recording medium.

A description will now be given of toner containers 50Y, 50M, 50C, and 50K that respectively store yellow, magenta, cyan, and black toners to be supplied.

Figure 3:
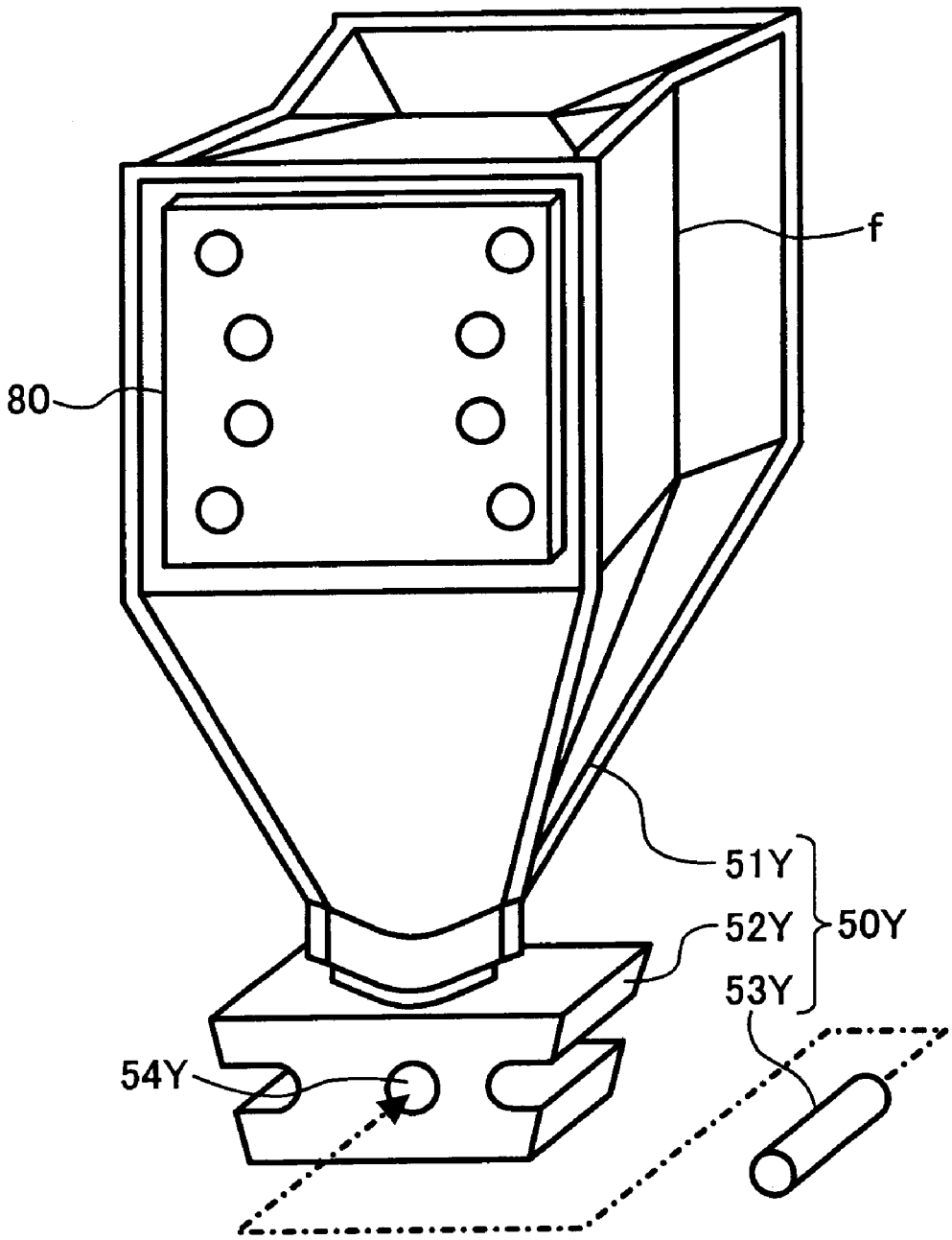
FIG. 3 is a perspective view of a yellow-toner container.

FIG. 3 is a perspective view of the toner container 50Y for yellow toner. The toner container 50Y includes a flexible bag 51Y, a cap 52Y, and a cylindrical shutter 53Y. The bag 51Y is a square bag made of a single or a plurality of deformable and flexible sheet materials having a thickness of approximately 50 μm to 210 μm, and stores yellow toner. The sheet material is, for example, a resin sheet of polyester, polyethylene, or nylon, or a paper sheet. In this embodiment, the bag 51Y has two layers, that is, an inner layer made of a polyethylene sheet to which the cap 52Y can be welded, and an outer layer made of a nylon sheet to cover the inner layer. Reinforcing layers 80 made of, for example, polyethylene terephthalate or aluminum are provided on outer flat portions of the front and rear faces (front and rear sides of the plane of the figure) of the bag 51Y.

Since the flat portions are maintained flat by the action of the reinforcing layers 80 during a volume reduction process of the bag 51Y they will not be crinkled and waved. Consequently, folds f are not disturbed by crinkling and waving, and the bag 51Y can be neatly folded along the folds f after volume reduction.

Each of the reinforcing layers 80 has eight holes, as shown in FIG. 3. The operator can hold the bag 51Y with the fingers put in the holes. Therefore, high efficiency is ensured when the operator holds and shakes the toner container 50Y and loads the toner container 50Y in a container holder which will be described later. Furthermore, these holes also function as marks that indicate to the operator proper positions at which the fingers should be placed to hold the bag 51Y. Accordingly, the operator can properly hold the bag 51Y without disturbing the holds f, and the bag 51Y can take a fixed shape after volume reduction.

In an expanded state, the upper half of the bag 51Y is shaped like a substantially rectangular parallelepiped, and the lower half is shaped like an inverse quadrangular pyramid (tapered). This shape of an inverse quadrangular pyramid defines a hopper that is inclined downward toward the cap 52Y. The cap 52Y, which is made of, for example, resin and does not deform, is welded to the leading end of the hopper. The toner container 50Y is used with the cap 52Y down, and the bag 51Y communicates with the cap 52Y. A nozzle-receiving hole 54Y horizontally extends through the cap 52Y, and a cylindrical shutter 53Y is fitted in the nozzle-receiving hole 54Y to seal yellow toner in the toner container 50Y. While only the toner container 50Y for yellow toner has been described with reference to FIG. 3, the toner containers 50M, 50C, and 50K for other color toners have a similar structure, and therefore, descriptions thereof are omitted.

A description will now be given of the configuration and operation of a toner-conveying device for conveying supply toner to each developing device.

Figure 4:
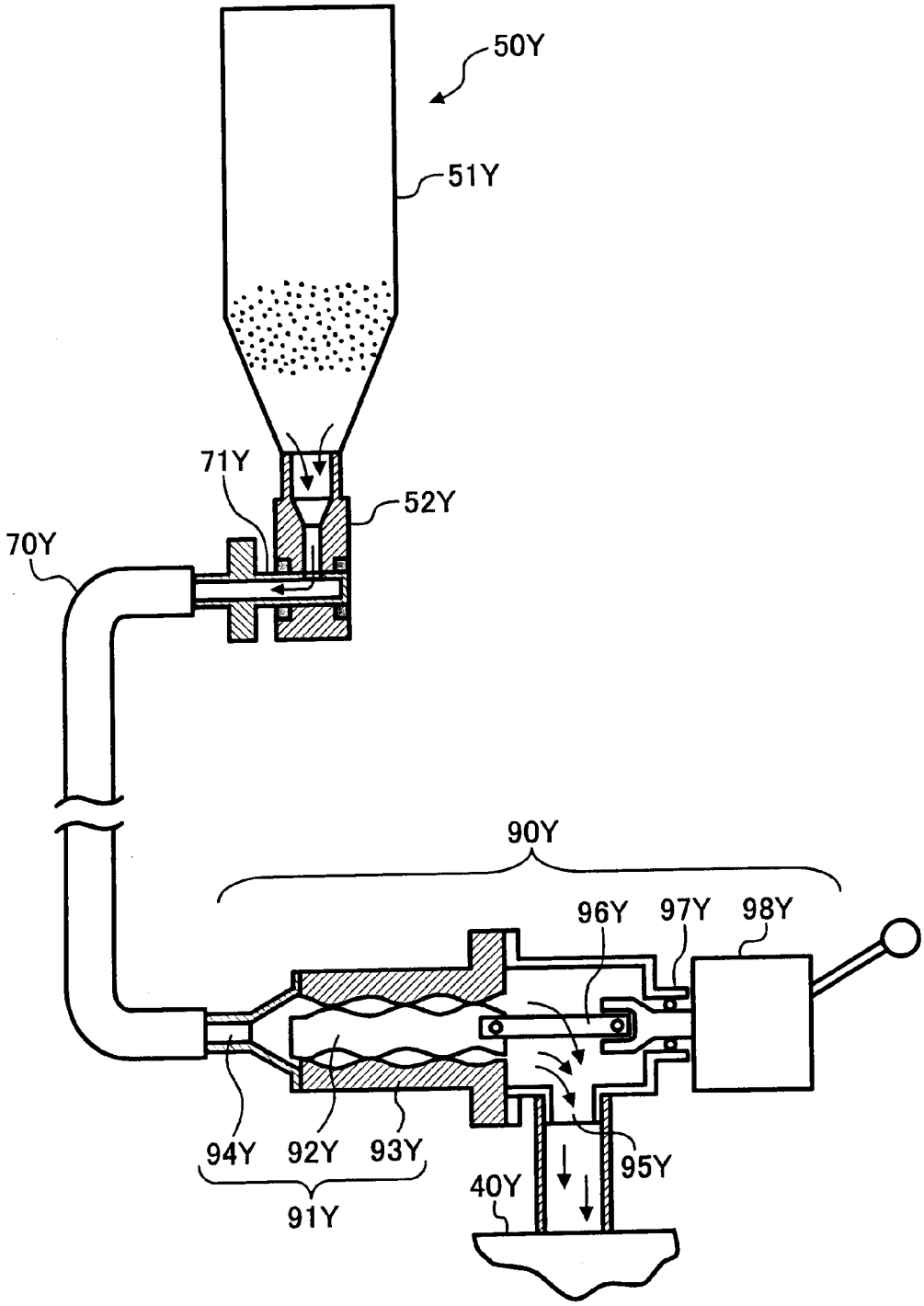
FIG. 4 is a schematic structural view showing a yellow-toner conveying device and a part of a yellow-toner developing device.

FIG. 4 is a schematic structural view showing a toner-conveying device for yellow toner and a part of the developing device for yellow toner. The toner-conveying device includes a conveying tube 70Y, a nozzle 71Y that defines a conveyor path, a suction pump 90Y, and a container holder (not shown) serving as a container support for supporting the toner container 50Y The toner container 50Y is loaded in the container holder with the cap 52Y facing down, and is replaced by new one when toner is almost consumed. In this case, the leading end of the nozzle 71Y is fitted in a nozzle-receiving hole 54Y of a cap 52Y of a new toner container 50Y in which a shutter 53Y shown in FIG. 3 is engaged. Consequently, the shutter 53Y is pushed out of the nozzle-receiving hole 54Y, and the nozzle 71Y engages with the nozzle-receiving hole 54Y and is coupled to the cap 52Y. As a result, a toner-conveying path is formed to convey yellow toner discharged form the toner container 50Y to the developing device 40Y.

The conveying tube 70Y is connected to the rear end of the nozzle 71Y, and is made of, for example, a rubber or resin material that is deformable and toner-resistant, and has an inner diameter of 4 mm to 10 mm. The conveying tube 70Y is connected to a pump unit 91Y of the suction pump 90Y at an end remote from the nozzle 71Y. The suction pump 90Y is a uniaxial eccentric screw pump (popularly called a Mono pump), and includes the pump unit 91Y, an outlet 95Y communicating with the pump unit 91Y, a shaft 96Y, a universal joint 97Y, and a suction motor 98Y.

The pump unit 91Y of the suction pump 90Y includes a rotor 92Y formed of an eccentric double-thread screw made of metal or resin having high rigidity, a stator 93Y made of, for example, rubber and having a cavity shaped like a double-thread screw, and a suction inlet 94Y. When the suction motor 98Y rotates, the rotational force is transmitted to the rotor 92Y through the universal joint 97Y and the shaft 96Y. The rotor 92Y then rotates inside the stator 93Y, a negative pressure is produced at the suction inlet 94Y of the pump unit 91Y. Yellow toner in the bag 51Y is sucked into the suction pump 90Y by the negative pressure through the conveying tube 70Y, the nozzle 71Y, and the cap 52Y. Subsequently, the yellow toner is discharged into the outlet 85Y through the stator 93Y. The outlet 95Y is connected to the second supply section of the developing device 40Y, and the yellow toner is supplied from the outlet 95Y to the second supply section to be mixed with a two-component developing agent (not shown).

The toner-conveying device for conveying yellow toner by the suction of the suction pump 90Y in this way does not need a moving member, such as an auger, for applying a moving force to the yellow toner in the toner container 50Y. Therefore, the structure of the toner container 50Y is simplified, and the weight thereof is reduced. Moreover, the volume of the toner container 50Y can be reduced by deflating the deformable bag 51Y by a suction force of the suction pump 90Y. When the used toner container 50Y is taken back by, for example, a manufacturer for recycle, the cost of transporting the toner container 50Y can be reduced by the weight reduction and volume reduction. Since it is also unnecessary to place a moving member, such as a screw, in the conveying tube 70Y for conveying the toner, the conveying tube 70Y can be made of a deformable material and can be freely laid out in the printer. This substantially increases the degree of layout flexibility of the toner-conveying path. Even when the toner container 50Y is placed on the lower side of the developing device 40Y in the gravitational direction, the toner can be pumped up and conveyed by the suction force of the suction pump 90Y. This also increases the degree of layout flexibility in the printer.

Figure 5:
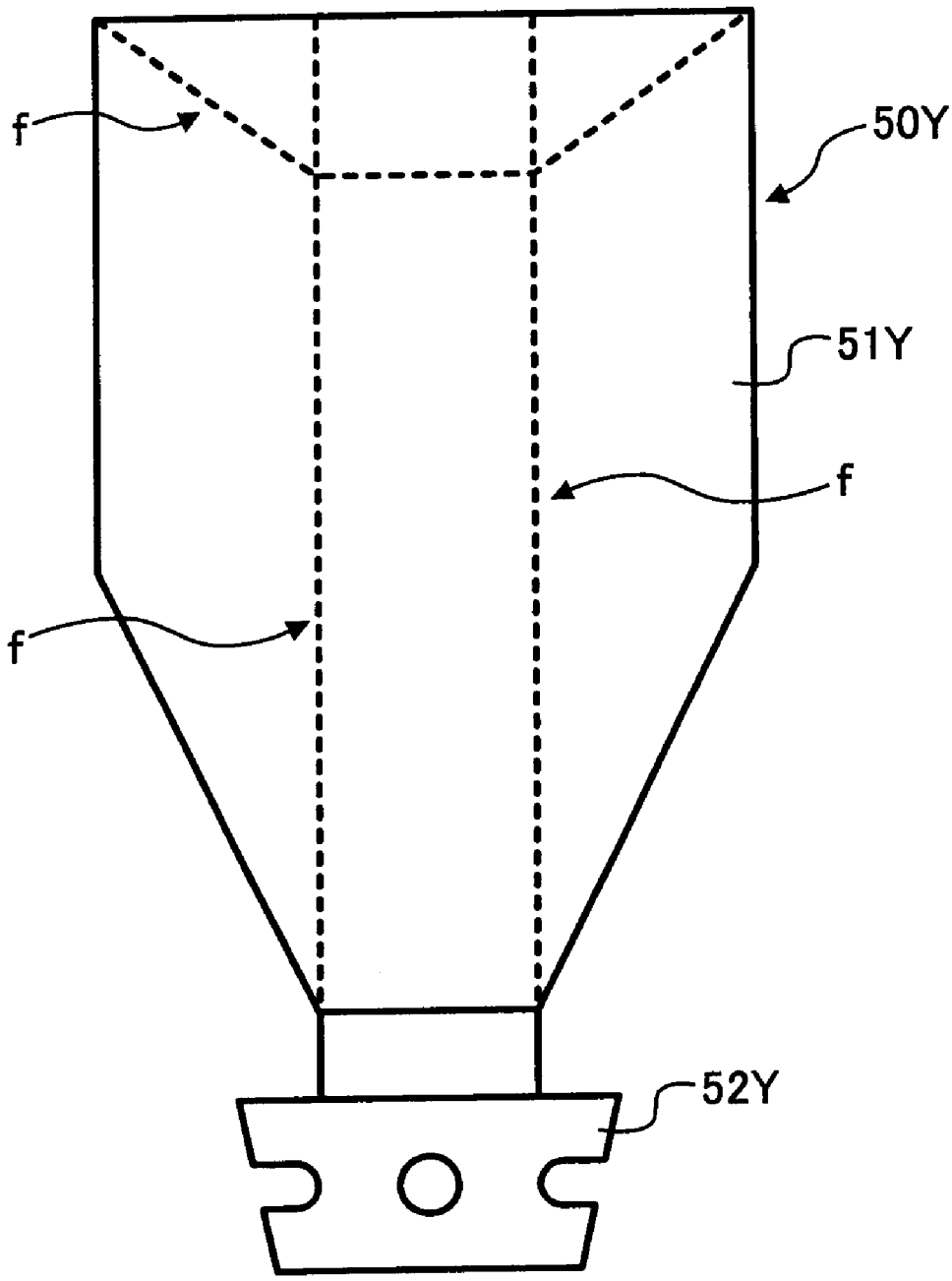
FIG. 5 is an explanatory view showing a state of the yellow toner container after volume reduction.

Preferably, the bag 51Y of the toner container 50Y has folds f, as shown in FIG. 3. In this case, it is possible to deflate the bag 51Y along the folds f by suction and to finally fold the bag 51Y into a substantially planar shape, as shown in FIG. 5. Consequently, the volume of the toner container 50Y is further reduced, and the transport cost is further reduced.

Figure 6:
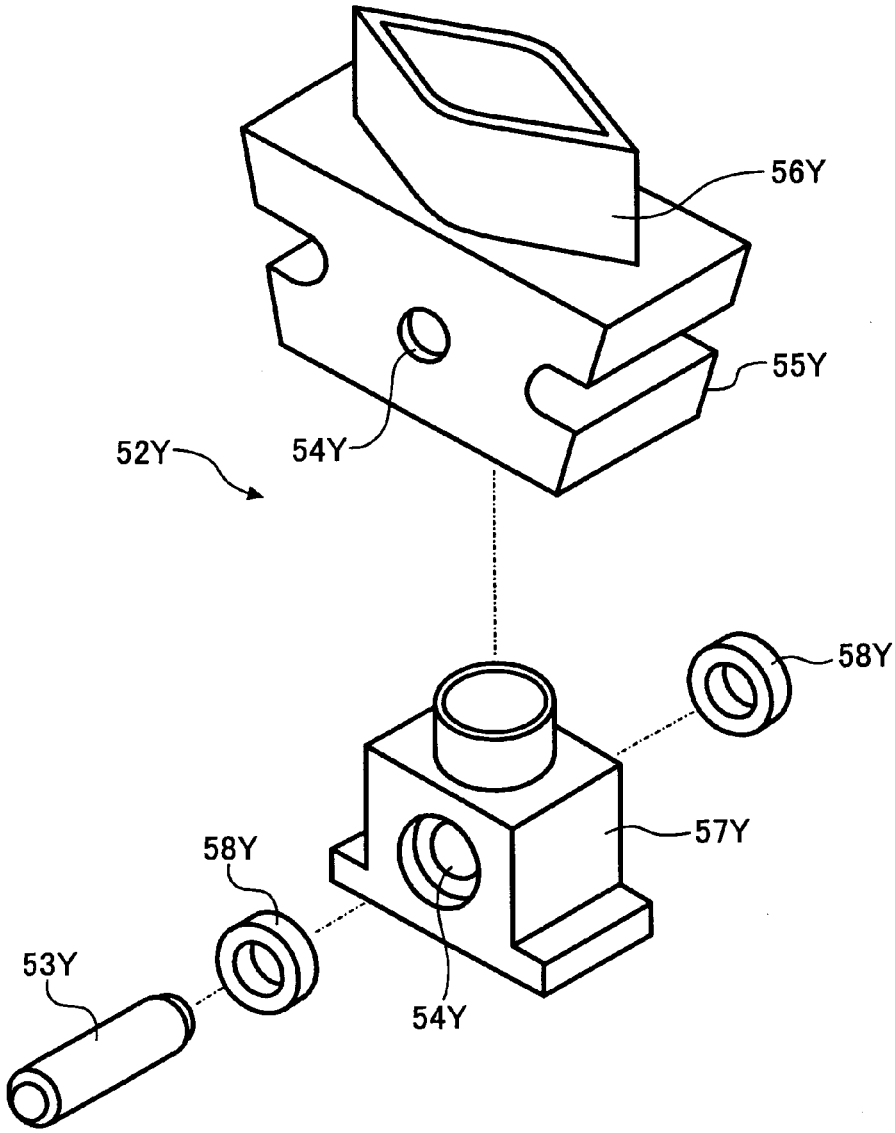
FIG. 6 is an exploded perspective view of an example of a cap of the yellow-toner container.

FIG. 6 is an exploded perspective view of an example of a cap 52Y of the toner container 50Y. The cap 52Y includes a main portion 55Y having a large vertical hole and a horizontal nozzle-receiving hole 54Y, a welding portion 56Y of circular cross section protruding from the upper surface of the main portion 55Y, and a cap portion 57Y to be fitted in the vertical hole of the main portion 55Y from below. The welding portion 56Y is welded to the opening of the above-described bag 51Y in order to fix the cap 52Y to the bottom of the bag 51Y. The cap portion 57Y also has a nozzle-receiving hole 54Y. That is, the nozzle-receiving hole 54Y horizontally extends through the main portion 55Y and the cap portion 57Y fitted therein. Ring-shaped seals 58Y made of an elastic material, such as rubber, are fixed at both ends of the nozzle-receiving hole 54Y of the cap portion 57Y. Accordingly, when the nozzle 71Y and the shutter 53Y are put in the nozzle-receiving hole 54Y, the interior of the nozzle-receiving hole 54 is hermetically sealed.

The cap 52Y is divided into the main portion 55Y and the cap portion 57Y in order to easily fill the bag 51Y with yellow toner. When the main portion 55Y and the cap portion 57Y are combined, yellow toner must be supplied from the narrow nozzle-receiving hole 54Y that extends at an angle of 90° to the toner path leading from the bag 51Y. In contrast, when the main portion 55Y and the cap portion 57Y are separate, yellow toner can be supplied straight to the bag 51Y from the large hole of the cap 52Y that extends straight from the toner path. Moreover, the ring-shaped seals 58Y can be prevented from being soiled with yellow toner during a toner supply operation. In order to prevent the shutter 53Y from being pushed out of the nozzle-receiving hole 54Y by the finger, it is preferable that the shutter 53Y has a small diameter such as not to be pushed by the finger. The cross-sectional area of the shutter 53Y is preferably set at 8 $mm^2$ or less, more preferably, 6 $mm^2$ or less.

Figure 7:
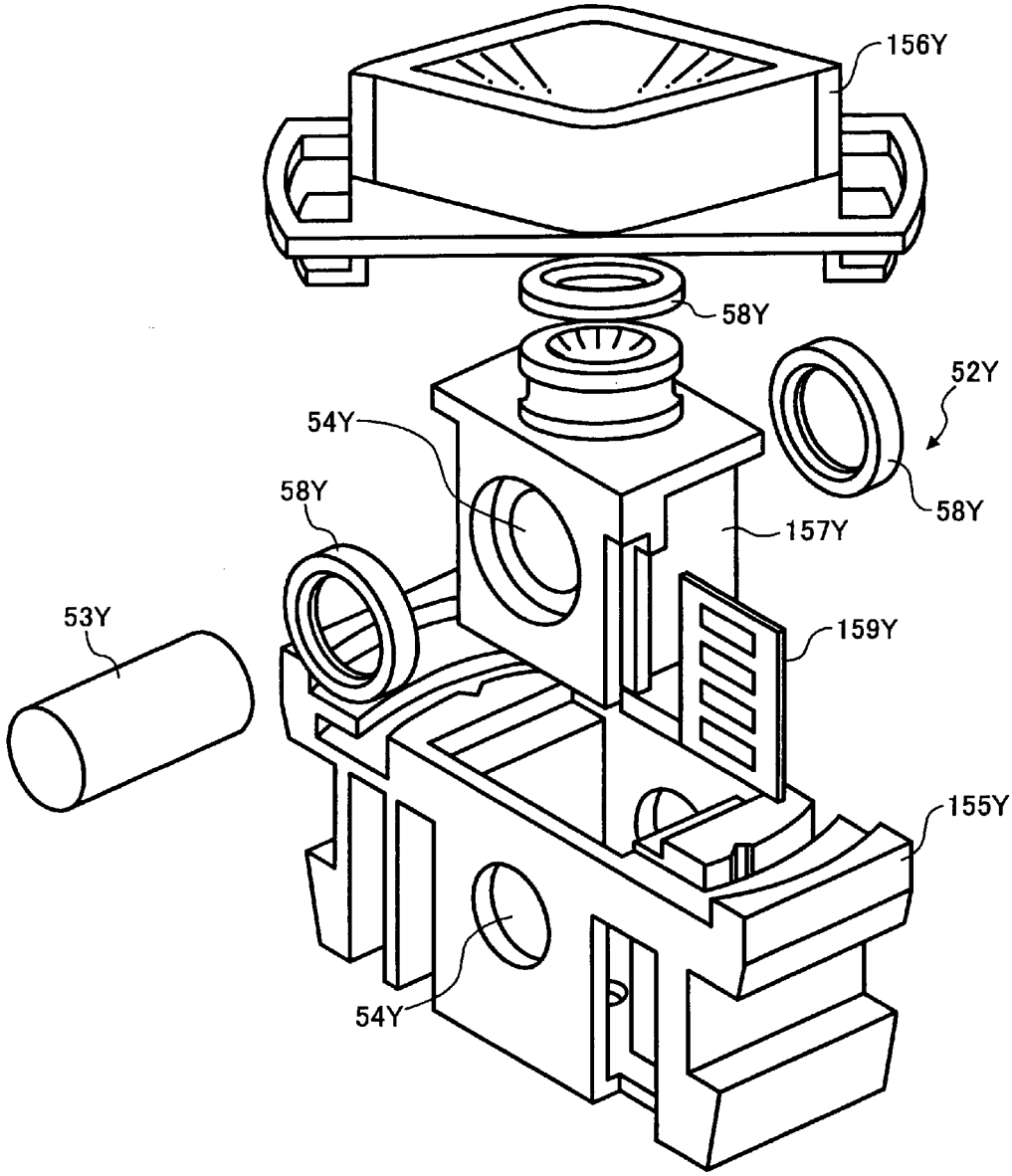
FIG. 7 is an exploded perspective view of another example of a cap of the yellow-toner container.

FIG. 7 is an exploded perspective view of another example of a cap 52Y of the toner container 50Y. The cap 52Y includes a welding portion 156Y, a main portion 155Y engaged with the welding portion 156Y, and a cap portion 157Y fitted in a vertical hole of the main portion 155Y from above. The welding portion 156Y is welded to the opening of the above-described bag 51Y By engaging the welding portion 156Y with the main portion 155Y in which the cap portion 157Y is fitted in the vertical hole, the cap 52Y is fixed to the bottom of the bag 51Y. In this case, the top of the cap portion 157Y is fitted in a hole of the welding portion 156, and a gap therebetween is sealed by a ring-shaped seal 58Y In a normal condition, there is no problem even when the ring-shaped seal 58Y is not provided. However, in a reduced-pressure condition (highland condition), when the ring-shaped seal 58Y is not provided, air leaks from the bag 51Y, and toner packing occurs when the condition returns to the normal condition. In order to prevent toner packing, the ring-shaped seal 58Y is provided in the fitting portion between the top of the cap portion 157Y and the hole of the welding portion 156Y in the toner container 50Y shown in FIG. 7.

A circuit board 159Y is mounted in the main portion 155Y of the cap 52Y The circuit board 159Y includes, for example, an electric circuit and a memory in order to check the loading of the toner container 50Y and the amount of residual toner from the main body of the printer. When the toner container 50Y is loaded in the main body of the printer, a connecting terminal of the circuit board 159Y touches a connecting terminal of the main body, and information is exchanged between the circuit board 159Y and the main body, so that the presence of the toner container 50Y and the amount of residual toner can be checked.

The configuration of the toner-conveying device, which is a typical characteristic the present invention, will be described below.

Figure 8:
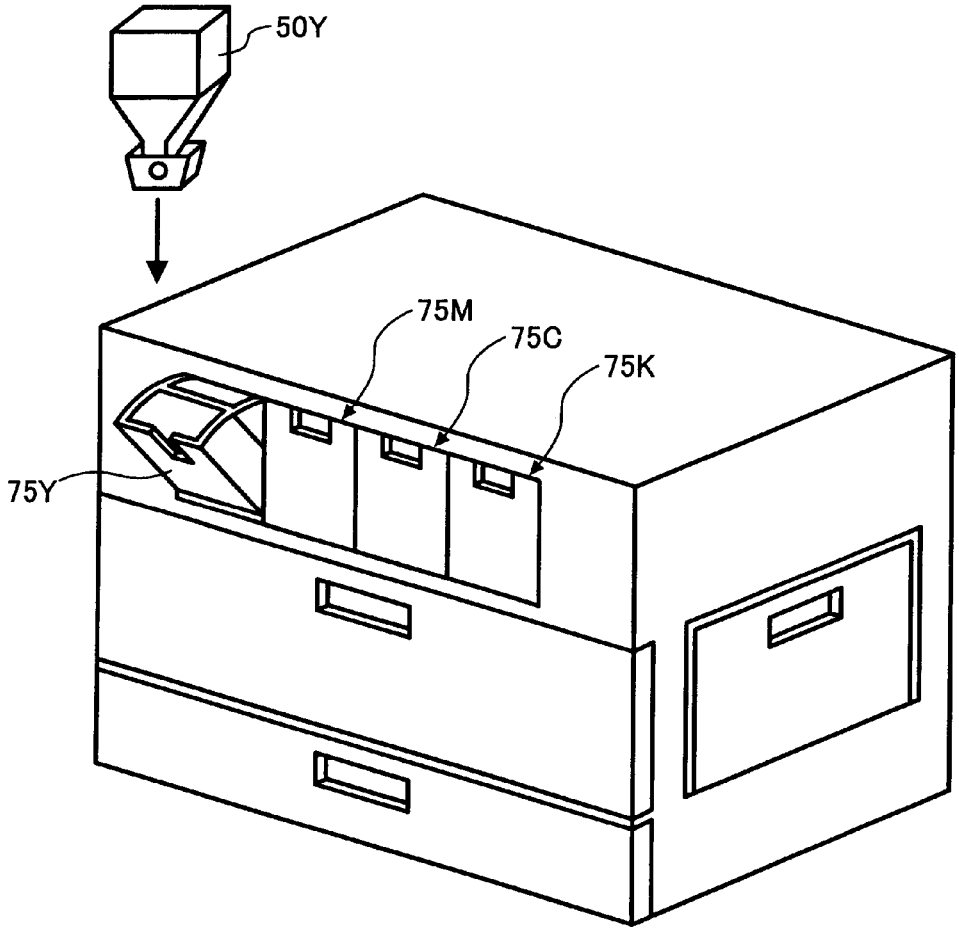
FIG. 8 is a perspective view of the printer.

FIG. 8 is a perspective view of the printer. Referring to FIG. 8, four container holders 75Y, 75M, 75C, and 75K that turn on pivots (not shown) are provided at the front of a housing of the printer. The container holders 75Y, 75M, 75C, and 75K define toner-conveying devices for the respective color toners, and house and support toner containers for the respective colors. For example, in order to load the toner container 50Y for yellow toner in the container holder 75Y, the operator opens a lock (not shown), and pivots the container holder 75Y forward, as shown in FIG. 8. The operator then drops the toner container 50Y into the container holder 75Y while holding the bag 51Y with both hands so that the cap 52Y faces downward in the vertical direction.

Figure 9:
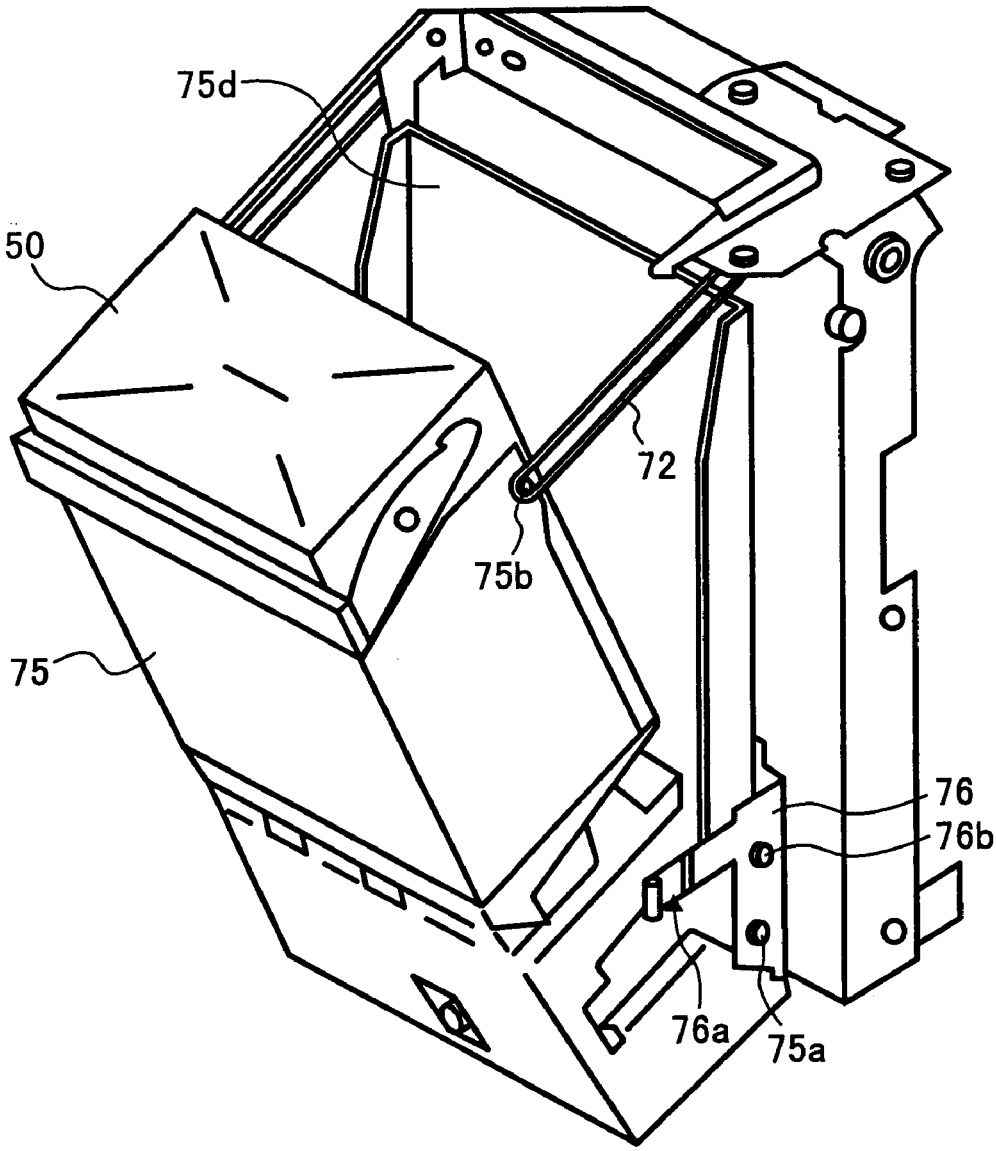
FIG. 9 is a perspective view of a container holder in the yellow-toner conveying device.

FIG. 9 is a perspective view of the container holder 75 in the toner-conveying device for yellow toner. While the toner-conveying device for yellow toner will be described below as an example, the toner-conveying devices for other color toners have a similar structure. For convenience of explanation, the letters Y, M, C, and K for representing the colors are omitted.

The toner-conveying device includes a fixed portion 76 fixed to the main body of the printer. A pivot shaft 75*a* is rotatably fixed to the fixed portion 76 at the bottom of the container holder 75. The container holder 75 can thereby turn on the pivot shaft 75*a*. Projections 75*b* are provided on both side faces on the upper side of the container holder 75, and are engaged with two slide members 72 turnably attached to the main body of the printer. Both side faces at the lower side of the container holder 75Y are in contact with arms 76*a* extending from the fixed portion 76, and are provided with stoppers (not shown) that regulate the movement relative to the arms 76*a*. The opening range of the container holder 75 is regulated by the retention of the slide members 72 by the projections 75*b* and the retention of the arms 76*a* by the stoppers. In this way, a holder-driving mechanism serving as the container-support driving mechanism for moving the container holder 75 is provided between a loading position at which the toner container 50 is loaded or unloaded and a stored position at which the toner container 50 is stored in the main body of the printer.

The container holder 75 has a back-face support portion 75*d* for supporting the side of the toner-container 50 close to the printer body. The back-face support portion 75*d* is pivotally supported at the lower end by the container holder 75. While the back-face support portion 75*d* tilts forward together with the container holder 75 because of its own weight when the container holder 75 is opened, it can retreat toward the printer body, as shown in FIG. 9. In such a structure, even when toner concentrates in the lower part of the toner container 50 because of its own weight and the bottom of the bag 51 bulges, the toner container 50 can be easily loaded in the container holder 75. When the container holder 75 is closed, the back-face support portion 75*d* is sandwiched between the toner container 50 and the printer body.

Figure 10A:
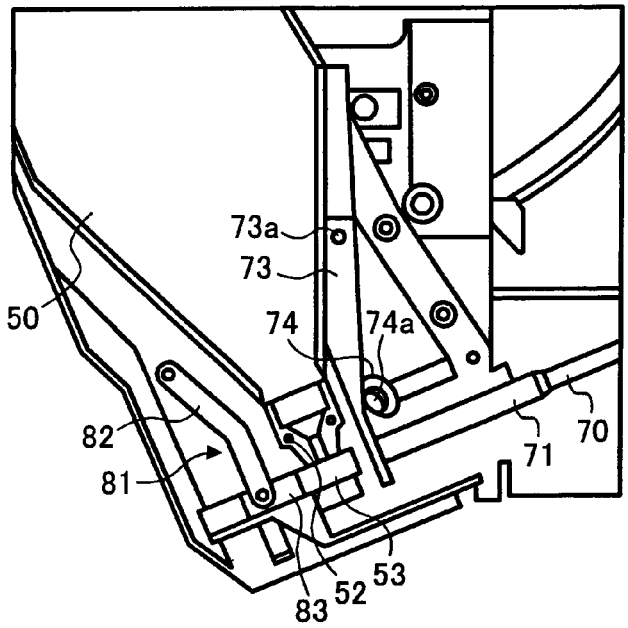
FIGS. 10A and 10B are vertical cross-sectional views of the yellow-toner conveying device, taken along a nozzle-receiving hole of the cap, respectively shoring a state in which the container holder is opened and a state in which the container holder is closed.
Figure 10B:
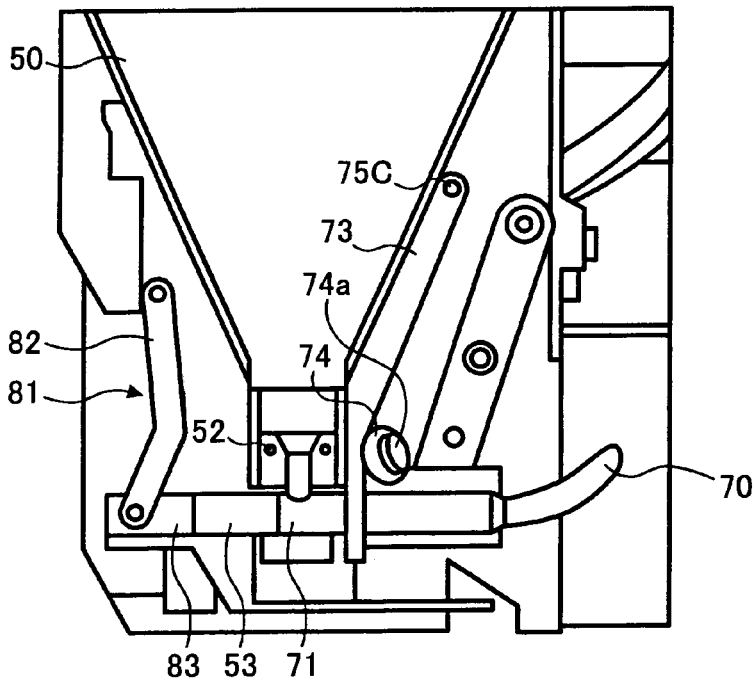

FIGS. 10A and 10B are vertical cross-sectional views of the toner-conveying device for yellow toner, taken along the nozzle-receiving hole 54 of the cap 52. FIG. 10A shows a state in which the container holder 75 is opened to allow the toner container 50 to be loaded or unloaded, and FIG. 10B shows a state in which the container holder 75 is closed.

As shown in FIGS. 10A and 10B, the toner-conveying device includes a movable plate 73 serving as the cap holder. The movable plate 73 can pivot on a pivot shaft 73*a* fixed to the bottom of the container holder 75, and can move between a retreating position shown in FIG. 10A and a holding position shown in FIG. 10B. A cam face of a cam 74 is in contact with a lower portion of a surface of the movable plate 73 remote from the toner container 50 loaded in the container holder 75. A cam shaft 74*a* of the cam 74 is rotatably attached to the container holder 75, and the cam 74 is rotated by a driving force transmitted to a cam-driving gear provided at one end of the cam shaft 74*a*. With the rotation of the cam 74, the movable plate 73 pivots on the pivot shaft 73*a* between the retreating position and the holding position. Accordingly, the cam 74, the cam shaft 74*a*, and the cam-driving gear constitute the positioning means.

Figure 11A:
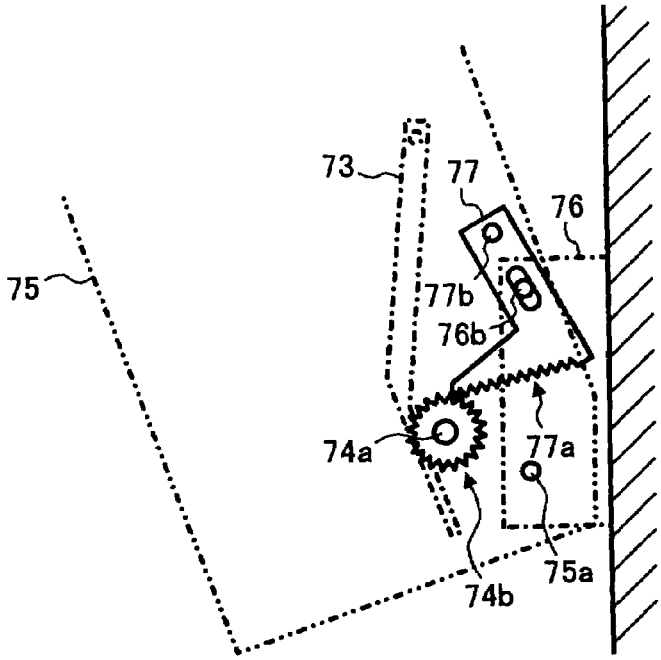
FIGS. 11A and 11B are explanatory views of a driving mechanism for turning a cam, respectively showing a state in which the container holder is opened and a state in which the container holder is closed.
Figure 11B:
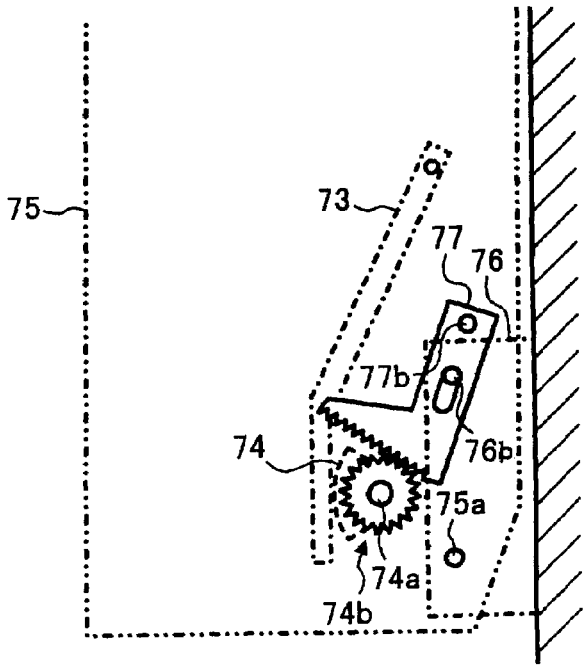

FIGS. 11A and 11B are explanatory views of a driving mechanism for rotating the cam 74. FIG. 11A shows a state in which the container holder 75 is opened so that the toner container 50 can be loaded or unloaded, and FIG. 11B shows a state in which the container holder 75 is closed. In these figures, the container holder 75 is shown by a two-dot chain line, and the movable plate 73 and the fixed portion 76 are shown by one-dot chain lines.

A cam-driving gear 74*b* provided on the cam shaft 74*a* of the cam 74 is meshed with a gear portion 77*a* of a substantially L-shaped sector gear 77. One end of the sector gear 77 is turnably mounted on a pivot shaft 77*b* fixed to the container holder 75. The sector gear 77 has, in the center thereof, a slot through which the fixed shaft 76*b* fixed to the fixed portion 76 extends.

In this structure, in order to close the container holder 75 in an open state shown in FIG 11A, the operator pushes the forward tilting container holder 75 into a state shown in FIG. 11B. When the container holder 75 is thus moved, the pivot shaft 77*b* at the end of the sector gear 77 moves, and the sector gear 77 makes an almost half turn in the clockwise direction on the fixed shaft 76*b*. The turning force is transmitted to the cam-driving gear 74*b* through the gear portion 77*a* of the sector gear 77, and the cam-driving gear 74*b* rotates counterclockwise by an almost half turn. In this embodiment, in order to ensure a rotation angle necessary for an almost half turn of the cam 74 even when the moving range of the container holder 75 is narrow, the above-described link mechanism is adopted as the driving mechanism for the sector gear 77, thus increasing the rotation angle of the sector gear 77 and controlling the gear ratio between the gear portion 77*a* of the sector gear 77 and the cam-driving gear 74*b*. While the moving range of the container holder 75 is set at 23° in this embodiment, a cam rotation angle of 168° is obtained. The cam 74 thus rotating is brought from the state shown in FIG. 10A into the state shown in FIG. 10B, and the movable plate 73 is pressed toward the toner container 50 by the cam face into the holding position. At the holding position, the cap 52 of the toner container 50 supported by the container holder 75 is coupled to the nozzle 71.

In contrast, in order to open the container holder 75 closed, as shown in FIG. 11B, the operator pulls the container holder 75 into a state shown in FIG. 11A. When the container holder 75 moves in this way, the cam 74 is conversely switched from the state shown in FIG. 10B to the state shown in FIG. 10A. Consequently, the cam face separates from the movable plate 73, and the movable plate 73 is released from the holding position and is allowed to pivot on the pivot shaft 73*a*. Therefore, the movable plate 73 can move to the retreating position shown in FIG. 10A. While the movable plate 73 is not positively moved to the retreating position in this embodiment, it may be positively moved. In this case, for example, the movable plate 73 may be biased by a spring toward the retreating position.

At the retreating position, loading and unloading of the toner container 50 into and from the container holder 75 are not hindered. More specifically, if the movable plate 73 remains in the holding position shown in FIG. 10B when the operator loads the toner container 50 in the container holder 75, the cap 52 of the toner container 50 is prone to be caught on the movable plate 73 and the inner wall of the container holder 75. Since the caught cap 52 cannot be inserted to the innermost portion of the container holder 75, it cannot be coupled to the nozzle 71, and the toner container 50 cannot be normally loaded. Since the cap 52 is easily caught particularly when it is in an improper posture, the toner container 50 cannot be loaded normally. In this embodiment, when the operator loads the toner container 50 in the container holder 75, the movable plate 73 can move to the retreating position shown in FIG. 10A. Therefore, the cap 52 of the toner container 50 to be loaded abuts against the movable plate 73, the movable plate 73 moves to the retreating position, and the space in which the cap 52 is inserted is enlarged. Accordingly, even when the posture of the cap 52 is slightly interfered with, the cap 52 is rarely caught on the movable plate 73, and can be smoothly inserted into the innermost portion of the container holder 75. Therefore, it is possible to prevent a situation in which the toner container 50 cannot be normally loaded because the cap 52 is caught.

In this embodiment, when the operator closes the container holder 75 after the cap 52 enters the innermost portion of the container holder 75 and the toner container is supported in the container holder 75, the movable plate 73 is correspondingly placed in the holding position. Consequently, the cap 52 is guided to the coupled position to the nozzle 71 by the movable plate 73 and is held at the position. As a result, the cap 52 can be properly coupled to the nozzle 71.

The toner container 50 has folds on the side faces of the bag 51 so that the bag 51 takes a predetermined shape after volume reduction, as shown in FIG. 3. Moreover, seams between sheets are flat along the front and back faces of the bag 51 so that the bag 52 becomes flat after volume reduction. For this reason, the front and back faces of the bag 51 near the cap 52 in the toner container 50 have a flexural rigidity lower than that of the side faces, and the cap 52 easily tilts toward the front or back face of the bag 51. Therefore, the moving direction of the movable plate 73 is set to coincide with the direction in which the front or back face faces when the toner container 50 is held in the container holder 75. This allows the cap 52 to be smoothly inserted to the innermost portion of the container holder 75.

Figure 12A:
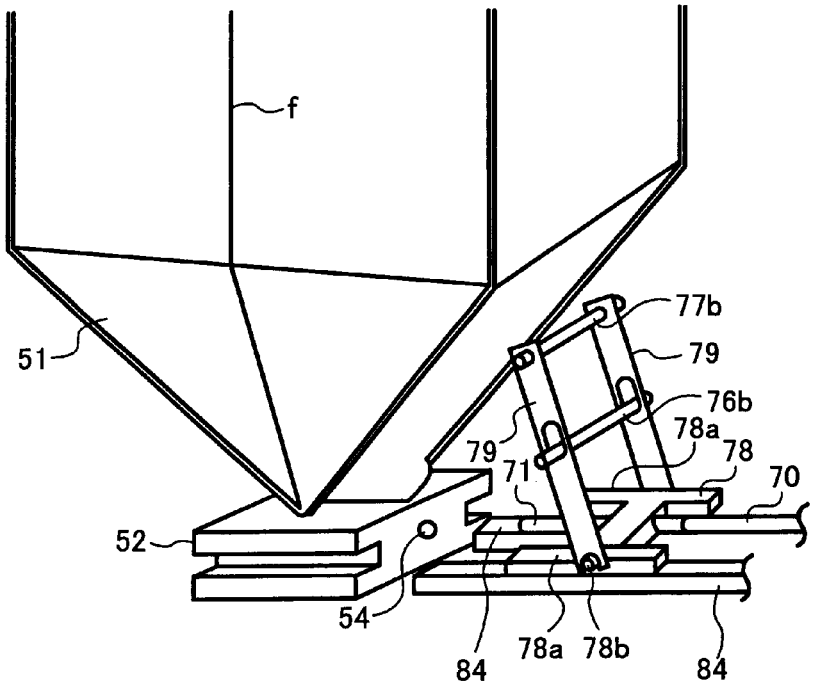
FIGS. 12A and 12B are explanatory views of a nozzle-driving mechanism, respectively showing a state in which the container holder is opened and a state in which the container holder is closed.
Figure 12B:
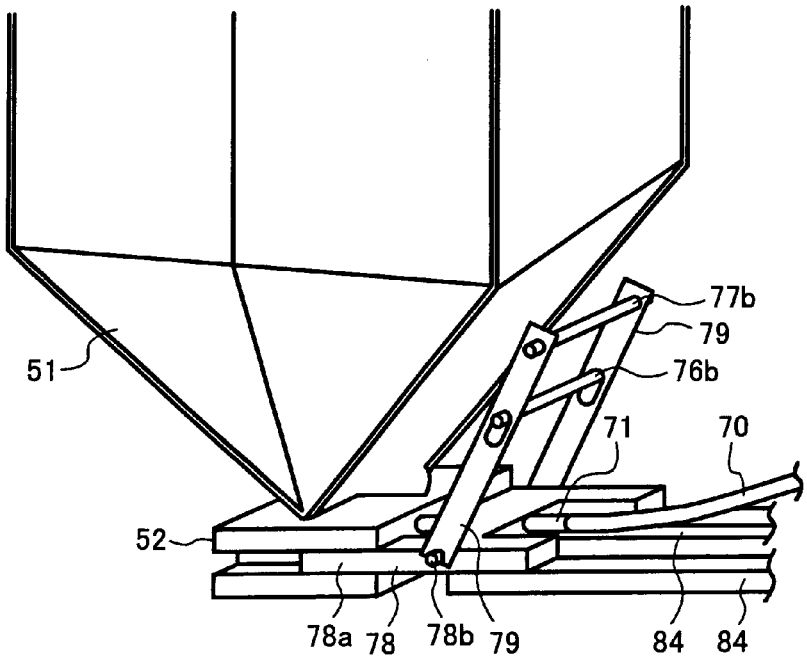
Figure 13:
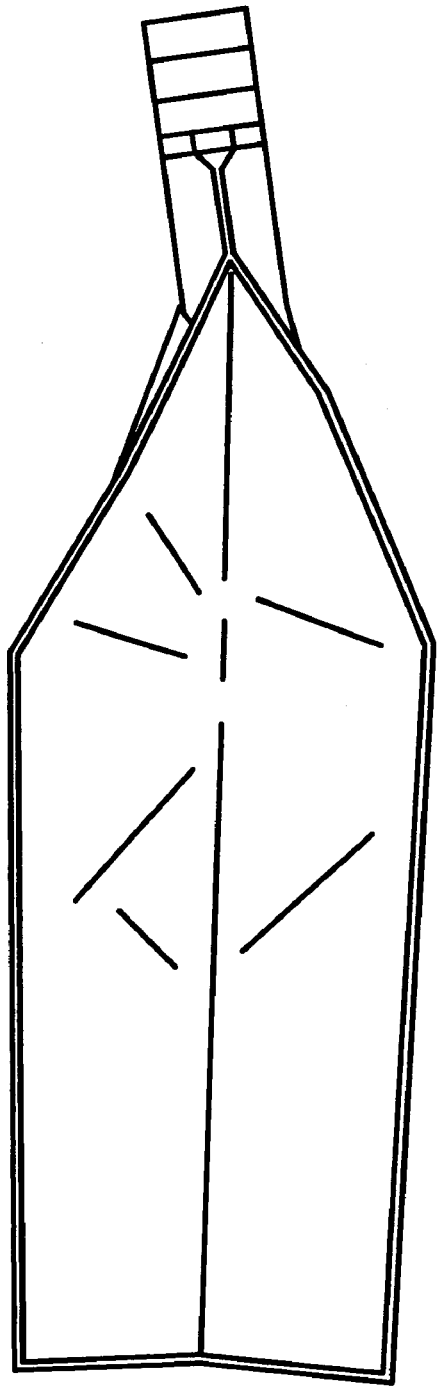
FIG. 13 is a side view of a toner container having a cap in an incorrect posture.

FIGS. 12A and 12B are explanatory views of a nozzle-driving mechanism formed of a link mechanism serving as the conveying-path-forming-member driving mechanism. FIG. 12A shows a state in which the container holder 75 is opened so that the toner container 50 can be loaded and unloaded, and FIG. 12B shows a state in which the container holder 75 is closed.

In the toner-conveying device of this embodiment, the nozzle 71 is provided at the inner bottom of the container holder 75. The nozzle 71 is connected to the conveying tube 70, as described above, and is fixed to a nozzle-holding member 78. The nozzle-holding member 78 has two protruding portions 78*a* extending parallel to the longitudinal direction of the nozzle 71. The protruding portions 78*a* are fitted in cutouts of the cap 52 simultaneously with the insertion of the nozzle 71, as shown in FIG. 12B. Protuberances 78*b* are provided on both side faces (front and back sides of the plane of the figure) of the nozzle-holding member 78, and are rotatably attached to one-end portions of a nozzle-driving member 79. The nozzle-driving member 79 is provided inside the above-described sector gear 77 and moves together therewith. Therefore, when the operator closes the container holder 75, the pivot shaft 77*b* correspondingly moves, and the nozzle-driving member 79 pivots clockwise on the fixed shaft 76*b*. The nozzle-holding member 78 is moved toward the cap 52 along guide rails 84 by the pivotal force, and reaches a coupled position at which the nozzle-holding member 78 is coupled to the cap 52 of the toner container 50 supported by the container holder 75. Consequently, the protruding portions 78*a* of the nozzle-holding member 78 are fitted in the cutouts of the cap 52, and the nozzle 71 enters the nozzle-receiving hole 54 of the cap 52, as shown in FIG. 12B. In contrast, when the operator opens the closed container holder 75, conversely, the nozzle-holding member 78 moves away from the cap 52 along the guide rails 84. The nozzle-holding member 78 then moves to an uncoupled position such as not to hinder loading and unloading of the toner container 50 into and from the container holder 75, as shown in FIG. 12A. Hence, the toner container 50 can be taken out of the container holder 75 while the cap 52 is not caught by the nozzle 71.

When the container holder 75 opens too wide when the toner container 50 is dropped in the container holder 75 from above, as in this embodiment, work efficiency of the operator is reduced. Furthermore, when the moving range of the container holder 75 is too wide, the container holder 75 excessively protrudes from the printer body, and a wide work space is necessary to load the toner container 50. This reduces usability. For this reason, the moving range of the container holder 75 is limited to a relatively narrow range. In this embodiment, the above-described link mechanism is adopted as the nozzle-driving mechanism. In this nozzle-driving mechanism, even when the optimum moving range of the container holder 75 is narrow, the pivot shaft 75*a* on which the container holder 75 turns can be provided near the cap 52 while ensuring a sufficient slide stroke of the nozzle 71. This eliminates a wasted space below the cap 52 in the toner-conveying device. In this embodiment, the pivot shaft 75*a* can be placed at the same height as that of the cap 52. In the above-described structure, the height of the toner container 50 that can be loaded in the toner-conveying device can be increased, and the amount of toner stored in the toner container 50 can be increased.

The nozzle-driving member 79 moves together with the sector gear 77. For this reason, the movable plate 73 is positioned in the holding position in response to the motion of the nozzle-driving mechanism for moving the nozzle 71 from the uncoupled position to the coupled position. Conversely, the movable plate 73 is released in response to the motion of the nozzle-driving mechanism for moving the nozzle 71 from the coupled position to the uncoupled position. Therefore, holding and releasing of the cap 52 by the movable plate 73 and insertion and withdrawal of the nozzle 71 can be performed in one operation, and the toner container 50 can be promptly loaded and unloaded.

In particular, for example, the shape of the cam 74 and the gear structures of the cam-driving gear 74*b* and the sector gear 77 are controlled so that the movement of the nozzle 71 to the coupled position is completed after the movable plate 73 is positioned in the holding position. When the cap 52 is in an improper posture and is not properly held in the coupled position by the movable plate 73, coaxiality between the nozzle 71 and the nozzle-receiving hole 54 of the cap 52 is not accomplished. For this reason, there is a probability that the cap 52 and the nozzle 71 will not be properly coupled. In contrast, in this embodiment, since the cap 52 is properly held in the coupled position by the movable plate 73 before the movement of the nozzle 71 to the coupled position is completed, even when the cap 52 is in an improper posture, it can be coupled to the nozzle 71 with high coaxiality. This prevents toner leakage due to improper coupling.

When the container holder 75 is closed, the sector gear 77 thereby turns clockwise on the fixed shaft 76b, as shown in FIGS. 11A and 11B. Therefore, the nozzle-driving member 79 shown in FIGS. 12A and 12B also turns clockwise. In this way, the nozzle-driving mechanism operates in connection with the operation of the holder-driving mechanism for closing the container holder 75, and the nozzle 71 moves from the uncoupled position to the coupled position. In contrast, when the container holder 75 is opened, the sector gear 77 thereby turns counterclockwise on the fixed shaft 76*b*, and the nozzle-driving member 79 also turns counterclockwise. In this way, the nozzle-driving mechanism operates with the operation of the holder-driving mechanism for opening the container holder 75, and the nozzle 71 moves from the coupled position to the uncoupled position. In this structure, when the operator opens or closes the container holder 75, the nozzle 71 is simultaneously withdrawn or inserted from or into the cap 52. Consequently, it is possible to promptly load and unload the toner container 50.

The cap 52 of the toner container 50 moves closer to the printer body when the container holder 75 is closed, and moves away from the printer body when the container holder 75 is opened. Therefore, the cap 52 moves in a coupling direction when the nozzle-driving member 79 moves from the uncoupled position to the coupled position, and moves in an opposite direction when the nozzle-driving member 79 moves from the coupled position to the uncoupled position. Since the cap 52 moves in the directions opposite from the inserting and withdrawing directions of the nozzle 71, the slide stroke of the nozzle 71 can be reduced by an amount corresponding to the moving amount of the cap 52. Consequently, the nozzle 71 can be reliably inserted into and withdrawn from the cap 52 while reducing the slide stroke of the nozzle 71. This structure is also effective when the movable plate 73 is not provided.

In order to insert the nozzle 71 into the nozzle-receiving hole 54 of the cap 52, high coaxiality is needed between the nozzle 71 and the nozzle-receiving hole 54. In this embodiment, the inserting and withdrawing direction of the nozzle 71 is the same as the moving direction of the movable plate 73, as shown in FIGS. 10A and 10B. In this case, shifting of the cap 52 can be regulated or the regulation is released by the movable plate 73 in the direction that has an influence on the coaxiality, that is, in the direction orthogonal to the inserting and withdrawing direction of the nozzle 71 into and from the cap 52. That is, when the movable plate 73 is placed in the holding position, the cap 52 is clamped between the movable plate 73 and the inner wall of the container holder 75, a large frictional force acts between the cap 52 and the movable plate 73. As a result, shifting of the cap 52 in the direction that has an influence on the coaxiality is regulated. Conversely, when the movable plate 73 is not placed in the holding position, little frictional force acts between the cap 52 and the movable plate 73. Therefore, the shifting of the cap 52 in that direction is not regulated. In this way, the shifting of the cap 52 in that direction can be controlled by the operation of the movable plate 73. Therefore, the leading end of the nozzle 71 enters the nozzle-receiving hole 54 of the cap 52 before the movable plate 73 is placed in the holding position. Consequently, the nozzle 71 can be smoothly inserted in the cap 52 with a small force. This control will be described more specifically. In a case in which the movable plate 73 is placed in the holding position before the leading end of the nozzle 71 is inserted in the cap 52, when the cap 52 is slightly deviated from the proper coupled position, the shifting of the cap 52 is limited by the frictional force between the cap 52 and the movable plate 73. For this reason, the nozzle 71 must be inserted with a large force such as to shift the cap 52 against the frictional force. In contrast, when the leading end of the nozzle 71 enters the nozzle-receiving hole 54 of the cap 52 before the movable plate 73 is placed in the holding position, as in this embodiment, the leading end can be inserted without being influenced by the frictional force. In this case, when the cap 52 is slightly deviated from the proper coupled position, it is shifted when the leading end of the nozzle 71 enters the nozzle-receiving hole 54. Since the frictional force does not act, the shifting needs a small force. Accordingly, the nozzle 71 can be smoothly inserted with a small force.

In the toner-conveying device of this embodiment, as shown in FIGS. 10A and 10B, the nozzle 71 is inserted into and withdrawn from the nozzle-receiving hole 54 so as to change places with the shutter 53 closing the nozzle-receiving hole 54. More specifically, the container holder 75 has, on the side of the cap 52 remote from the nozzle 71, a shutter-returning mechanism 81 for pushing the shutter 53 back into the nozzle-receiving hole 54. The shutter-returning mechanism 81 includes a pivot arm 82 pivotally supported at one end, and a push-back member 83 pivotally mounted on the other end of the pivot arm 82. The pivot arm 82 is biased by a spring (not shown) so as to pivot counterclockwise. In a state shown in FIG. 10A, the pivot arm 82 is held in contact with a stopper (not shown) by the biasing force. In this state, the leading end (right end in the figure) of the push-back member 83 is positioned so as not to protrude inside the inner wall of the container holder 75. In this embodiment, two springs are provided on both sides (front and rear sides of the plane of the figure) of the container holder 75 to bias the pivot arm 82. In order to bias the pivot arm 82 by a single spring, the spring must be placed on the lower side of the pivot arm 82. This increases the height of the toner-conveying device, and hinders size reduction.

When the nozzle 71 enters the nozzle-receiving hole 54 of the cap 52 from one end, the shutter 53 that plugs the nozzle-receiving hole 54 is pushed out from the other end. The push-back member 83 is then pushed by the pushed shutter 53, and the pivot arm 82 is pivoted clockwise against the force of the springs into a state shown in FIG. 10B. In contrast, when the nozzle 71 moves out of the nozzle-receiving hole 54, the pivot arm 82 is pivoted counterclockwise by the biasing force of the springs, and the push-back member 83 moves to the right. The shutter 53 is pushed by the push-back member 83, and is returned into the nozzle-receiving hole 54, as shown in FIG 10A.

In this method in which the shutter 53 is pushed into and out of the nozzle-receiving hole 54 of the cap 52, the conveying path of sucked toner is prevented from being obstructed by the shutter 53. Moreover, since the cap 52 does not need to have a space in which the shutter 53 retreats, it can be made compact. The shutter 53 can horizontally slide relative to the toner path that vertically extends from the interior of the bag 51 to the cap 52. Since the pressure from the bag 51 to the cap 52 can thereby vertically act on the horizontally slidable shutter 53, the shutter 53 will not be pushed out by the pressure.

Furthermore, the inserting and withdrawing direction of the nozzle 71 into and from the cap 52 of the toner container 50 is orthogonal to the loading and unloading direction of the toner container 50 into and from the container holder 75. This can reduce toner leakage when the toner container 50 is loaded and unloaded. Moreover, since the shutter 53 retreats outside the toner container 50 when the nozzle 71 is inserted, the toner container 50 does not need to have a special mechanism for reliably returning the shutter 53. As a result, it is possible to simplify the structure of the toner container 50 as a replacement component, to reduce the cost of the toner container 50, and to reduce the running cost. When the inserting and withdrawing direction of the nozzle 71 is set to be orthogonal to the loading and unloading direction of the toner container 50, the nozzle-driving mechanism need not be provided below the toner container 50, and therefore, the height of the toner-conveying device can be reduced. As a result, the height of the toner container 50 can be made large with respect to the size of the toner-conveying device, and the amount of toner to be stored can be increased.

When the shutter 53 is returned into the nozzle-receiving hole 54, a force in the moving direction of the shutter 53 is applied to the cap 52 by the frictional force between the shutter 53 and the inner wall of the nozzle-receiving hole 54. For this reason, if the movable plate 73 is released before the shutter 53 is returned in the nozzle-receiving hole 54, the cap 52 slips, and the shutter 53 cannot reliably return to the nozzle-receiving hole 54. In this case, toner remaining in the toner container 50 may leak. Accordingly, in this embodiment, the shape of the cam 74 and the structures of the cam-driving gear 74*b* and the sector gear 77 are controlled so that the nozzle 71 is moved from the coupled position to the uncoupled position before the cap 52 is released from the movable plate 73. Therefore, positioning by the movable plate 73 is released after the shutter 53 returns in the nozzle-receiving hole 54. As a result, the shutter 53 can be properly returned in the nozzle-returning hole 54, and toner remaining in the toner container 50 can be reliably prevented from leakage.

While the nozzle-driving mechanism operates so that the shutter-returning mechanism 81 follows the movement of the nozzle 71, the shutter-returning mechanism 81 may be driven with a structure similar to that of the nozzle-driving mechanism to follow the nozzle 71.

Since the toner container 50K for black toner is larger than the other toner containers 50Y, 50M, and 50C, the container holder 75k that supports the toner container 50K is also larger than the other container holders 75Y, 75M, and 75C. However, since the size of the cap 52 is equal among the toner containers 50Y, 50M, 50C, and 50K, only the size of the inner spaces of the container holders are different. For this reason, most of the components of the toner-conveying devices are commonly used.

The printer of this embodiment is an image forming apparatus in which a latent image formed on the sensitive drum 2 serving as the latent-image bearing member is developed into a toner image with toner by the developing device 40, and the toner image is transferred onto a transfer paper sheet P serving as the recording medium to form an image. The printer includes the toner container 50 that stores toner to be conveyed to the developing device 40, and the toner-conveying device serving as the conveyor device for conveying the toner in the toner container 50 to the developing device 40. The toner-conveying device includes the container holder 75 serving as the container support for detachably supporting the toner container 50. In the toner container 50, the bag 51 serving as the flexible bag that stores toner is deformed and is decreased in volume by applying an external pressure thereto or reducing the inner pressure, thereby discharging toner from the cap 52 serving as the cap provided at the opening of the bag 51. The toner-conveying device also includes the nozzle 71 serving as the conveying-path forming member that is coupled to the cap 52 of the toner container 50 supported by the container holder 75 and that defines a toner-conveying path in which toner discharged from the toner container 50 is conveyed to the developing device 40. The toner-conveying device also includes the movable plate 73 serving as the cap holder that is movable between the holding position such as to couple the cap 52 of the toner container 50 to the nozzle 71 when the toner container 50 is supported by the container holder 75, and the retreating position such as not to hinder loading and unloading of the toner container 50 into and from the container holder 75. The toner-conveying device also includes the cam 74, the cam shaft 74*a*, and the cam-driving gear 74*b* that constitute the positioning means for placing the movable plate 73 in the holding position. In this configuration, when the nozzle 71 is coupled to the cap 52, the movable plate 73 is placed in the holding position. When the toner container 50 is loaded or unloaded, the movable plate 73 is released from positioning and can move to the retreating position. As described above, even when the cap 52 of the toner container 50 is in an improper posture, it is not obstructed by the movable plate 73, and the toner container 50 can be supported by the container holder 75. Therefore, while rigidity of the bag 51 of the toner container 50 is set within a practically preferable range, the cap 52 of the toner container 50 can be neatly positioned in the toner-conveying device without reducing the operator's convenience.

When the toner container 50 is supported by the container holder 75, a portion of the bag 51 having a relatively low flexural rigidity near the cap 52 faces in a direction that substantially coincides with the moving direction of the movable plate 73. Since the cap 52 can be thereby more smoothly inserted to the innermost portion of the container holder 75, as described above, the operator can easily load the toner container 50.

The nozzle 71 can be inserted into and withdrawn from the cap 52 of the toner container 50. The nozzle 71 is fitted in the cap 52 to define the toner-conveying path, and the inserting and withdrawing direction of the nozzle 71 substantially coincides with the moving direction of the movable plate 73. Therefore, the motion of the movable plate 73 can regulate the shifting of the cap 52 in the direction orthogonal to the inserting and withdrawing direction, and can remove the regulation. As a result, the nozzle 71 can be smoothly inserted into the cap 52 with a small force.

The toner-conveying device also includes the nozzle-driving mechanism serving as the conveying-path-forming-member driving mechanism that moves the nozzle 71 between the coupled position at which the nozzle 71 is coupled to the cap 52 of the toner container 50 supported by the container holder 75 and the uncoupled position at which the nozzle 71 does not hinder the loading and unloading of the toner container 50 into and from the container holder 75. The movable plate 73 is placed in the holding position in response to the motion of the nozzle-driving mechanism for moving the nozzle 71 from the uncoupled position to the coupled position, and the movable plate 73 is released in response to the motion of the nozzle-driving mechanism for moving the nozzle 71 from the coupled position to the uncoupled position. This allows the toner container 50 to be promptly loaded and unloaded, as described above.

The toner-conveying device also includes the holder-driving mechanism serving as the container-support driving mechanism that moves the container holder 75 between the loading position at which the toner container 50 is loaded into or unloaded from the container holder 75 and the stored position at which the toner container 50 supported by the container holder 75 is stored in the printer. The nozzle-driving mechanism operates in response to the motion of the holder-driving mechanism for moving the container holder 75 from the loading position to the stored position, and moves the nozzle 71 from the uncoupled position to the coupled position. The nozzle-driving mechanism operates in response to the motion of the holder-driving mechanism for moving the container holder 75 from the stored position to the loading position, and moves the nozzle 71 from the coupled position to the uncoupled position. This allows the toner container 50 to be promptly loaded and unloaded, as described above.

The movement of the nozzle 71 from the uncoupled position to the coupled position is completed after the movable plate 73 is placed in the holding position. This prevents toner leakage due to improper coupling, as described above.

The movable plate 73 is placed in the holding position in response to the motion of the holder-driving mechanism for moving the container holder 75 from the loading position to the stored position. The positioning of the movable plate 73 is released in response to the motion of the holder-driving mechanism for moving the container holder 75 from the stored position to the loading position. This allows the toner container 50 to be promptly loaded and unloaded, as described above.

The nozzle 71 can be inserted into and withdrawn from the through nozzle-receiving hole 54 of the cap 52 that communicates with the opening of the bag 51, and is inserted in the nozzle-receiving hole 54 so that the toner-conveying path communicates with the opening. The nozzle 71 is inserted in and withdrawn from the nozzle-receiving hole 54 so as to change places with the shutter 53 that plugs the nozzle-receiving hole 54. Therefore, it is possible to prevent the conveying path for toner to be sucked from being obstructed by the shutter 53, and the cap 52 can be made compact, as described above. It is also possible to prevent the shutter 53 from being pushed out by the pressure from the bag 51 to the cap 52.

The inserting and withdrawing direction of the nozzle 71 into and from the cap 52 is substantially orthogonal to the loading and unloading direction of the toner container 50 into and from the container holder 75. This reduces the cost of the toner container 50 and the running cost, and increases the amount of toner to be stored, as described above.

The movable plate 73 is released after the shutter 53 returns in the nozzle-receiving hole 54 so as to change places with the cap 52. Therefore, the shutter 53 can be properly returned in the nozzle-receiving hole 54, and toner remaining in the toner container 50 can be reliably prevented from leakage.

The toner-conveying device also includes the cap-moving mechanism that moves the cap 52 in the coupling direction in response to the motion of the nozzle-driving mechanism for moving the nozzle 71 from the uncoupled position to the coupled position and that moves the cap 52 in a direction opposite to the coupling direction in response to the motion of the nozzle-driving mechanism for moving the nozzle 71 from the coupled position to the uncoupled position. Therefore, the nozzle 71 can be reliably inserted in and withdrawn from the cap 52 while reducing the range of movement of the nozzle 71 by the nozzle-driving mechanism.

Since the nozzle-driving mechanism is formed of a link mechanism, the possible height of the toner container 50 can be made large with respect to the size of the toner-conveying device, and the amount of toner to be stored can be increased.

While the conveyor device of this embodiment conveys toner powder, the present invention is not limited thereto. Similar advantages can be provided as long as the conveyor device conveys powder other than toner, liquid, or gas stored in the container to another device.

While the present invention has been described with reference to what is presently considered to be the preferred embodiment, it is to be understood that the invention is not limited to the disclosed embodiment. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A toner container, comprising:

a toner storing member which contains toner; and a cap, provided at a lower portion of the toner storing member, the cap including:

a hole through which toner exits the toner container, the hole configured to receive a horizontal nozzle of an image forming apparatus;

grooves in sides of the cap, the grooves being parallel to the hole and configured to receive corresponding protrusions of the image forming apparatus which are inserted into the grooves in a same direction as the nozzle.

2. A toner container according to claim 1, wherein:

the grooves are provided on opposite sides of the cap, with the hole of the cap disposed between the grooves.

3. A toner container according to claim 1, wherein:

the grooves are configured to be horizontal, when the toner storing member is above the cap and the hole is facing a horizontal direction.

4. A toner container according to claim 1, further comprising:

a shutter which opens and closes the hole.

5. A toner container according to claim 1, further comprising:

a path which communicates in a vertical direction the toner from the toner storing member towards the hole of the cap, wherein the hole of the cap extends in a horizontal direction.

6. A toner container according to claim 1, further comprising:

a weld attaching the toner storing member to the cap.

7. A method of conveying toner, comprising:

installing a toner container in an image forming apparatus using grooves in a cap of the toner container which are parallel to a horizontal hole in the cap and match with protrusions of the image forming apparatus, the protrusions being inserted into the grooves along a same direction as a nozzle of the image forming apparatus;

communicating toner from a storage volume of the toner container through a vertical path in a cap of the toner container;

communicating the toner from the vertical path to the nozzle of the image forming apparatus, the nozzle being inserted into the horizontal hole in the cap.

8. A method according to claim 7, wherein the installing comprises:

installing the toner container in the image forming apparatus using the grooves in the cap which are on opposite sides of the cap, with the horizontal hole of the cap disposed between the grooves.

9. A method according to claim 7, wherein the installing comprises:

installing the toner container in the image forming apparatus using the grooves which are oriented in a horizontal direction.

10. A method according to claim 7, further comprising:

moving a shutter, which blocks the hole, to an open position.

11. A method according to claim 7, wherein the installing comprises:

installing the toner container by lowering the toner container from a position above a position at which toner is communicated.

12. A method according to claim 7, further comprising:

removing the toner container by raising the toner container from a position at which toner is communicated.

13. A toner container, comprising:

a toner storage volume; and an interface, including:

a hole through which toner exits the toner container, the hole configured to receive a horizontal nozzle of an image forming apparatus;

grooves in sides of the interface, the grooves being parallel to the hole and configured to receive corresponding protrusions of the image forming apparatus which are inserted into the grooves in a same direction as the nozzle.

14. A toner container according to claim 13, further comprising:

a weld attaching the toner storage volume to the interface.

15. A toner container according to claim 13, further comprising:

a shutter disposed in the hole.

16. A toner container according to claim 15, wherein the shutter has a cylindrical shape.

17. A toner container according to claim 13, wherein the grooves are located at symmetrical positions about the hole of the interface.

18. A toner container according to claim 13, further comprising:

a circuit device including memory at a face of the interface which includes the hole.

19. A toner container according to claim 13, wherein at least a part of the toner storage volume comprises a bag.

20. A toner container according to claim 13, further comprising:

a seal at an inside of the hole.

21. A toner container according to claim 13, wherein the grooves comprise a groove at two sides of the interface.

22. A toner container, comprising:

a toner storage volume; and a valve portion, including:

a valve body including:

a hole through which toner exits the toner container, the hole configured to receive a horizontal nozzle of an image forming apparatus; and grooves in sides of the valve portion, the grooves being parallel to the hole and configured to receive corresponding protrusions of the image forming apparatus which are inserted into the grooves in a same direction as the nozzle, and the valve portion including a valve which closes the hole.

23. A toner container according to claim 22, further comprising:

a weld attaching the toner storage volume to the valve portion.

24. A toner container according to claim 22, wherein the valve comprises a cylindrical shutter.

25. A toner container according to claim 22, wherein the grooves are located at symmetrical positions about the hole of the valve portion.

26. A toner container according to claim 22, further comprising:

a circuit device including memory at a face of the valve body which includes the hole.

27. A toner container according to claim 22, wherein at least a part of the toner storage volume comprises a bag.

28. A toner container according to claim 22, further comprising:

a seal at an inside of the hole.

29. A toner container according to claim 22, wherein the grooves comprise a groove at two sides of the valve portion.

* * * * *